US010286694B2

(12) United States Patent
d'Armancourt

(10) Patent No.: US 10,286,694 B2
(45) Date of Patent: May 14, 2019

(54) ULTRA COMPACT PRINTER

(71) Applicant: Datamax-O'Neil Corporation, Orlando, FL (US)

(72) Inventor: Sébastien Michel Marie Joseph d'Armancourt, Singapore (SG)

(73) Assignee: Datamax-O'Neil Corporation, Orlando, FL (US)

( * ) Notice: Subject to any disclaimer, the term of this patent is extended or adjusted under 35 U.S.C. 154(b) by 0 days.

(21) Appl. No.: 15/255,893

(22) Filed: Sep. 2, 2016

(65) Prior Publication Data

US 2018/0065386 A1 Mar. 8, 2018

(51) Int. Cl.

| | |
|---|---|
| ***B41J 25/312*** | (2006.01) |
| ***B41J 25/00*** | (2006.01) |
| ***B41J 2/335*** | (2006.01) |
| ***B41J 3/407*** | (2006.01) |
| ***B41J 15/04*** | (2006.01) |
| *B41J 3/01* | (2006.01) |

(52) U.S. Cl.

CPC ..... *B41J 25/001* (2013.01); *B41J 2/3351* (2013.01); *B41J 3/4075* (2013.01); *B41J 15/04* (2013.01); *B41J 3/01* (2013.01)

(58) Field of Classification Search

CPC ..... B41J 25/304; B41J 25/316; B41J 25/312; B41J 25/308; B41J 25/3088; B41J 25/3086; B41J 25/3084; B41J 25/3082; B41J 2/32; B41J 2/355

See application file for complete search history.

(56) References Cited

U.S. PATENT DOCUMENTS

| | | | |
|---|---|---|---|
| 6,832,725 | B2 | 12/2004 | Gardiner et al. |
| 7,128,266 | B2 | 10/2006 | Zhu et al. |
| 7,159,783 | B2 | 1/2007 | Walczyk et al. |
| 7,413,127 | B2 | 8/2008 | Ehrhart et al. |
| 7,726,575 | B2 | 6/2010 | Wang et al. |
| 8,294,969 | B2 | 10/2012 | Plesko |
| 8,317,105 | B2 | 11/2012 | Kotlarsky et al. |
| 8,322,622 | B2 | 12/2012 | Liu |
| 8,366,005 | B2 | 2/2013 | Kotlarsky et al. |
| 8,371,507 | B2 | 2/2013 | Haggerty et al. |
| 8,376,233 | B2 | 2/2013 | Van Horn et al. |

(Continued)

FOREIGN PATENT DOCUMENTS

| | | | |
|---|---|---|---|
| WO | 2013163789 | A1 | 11/2013 |
| WO | 2013173985 | A1 | 11/2013 |

(Continued)

OTHER PUBLICATIONS

U.S. Appl. No. 14/715,916 for Evaluating Image Values filed May 19, 2015 (Ackley); 60 pages.

(Continued)

*Primary Examiner* — Kristal Feggins
(74) *Attorney, Agent, or Firm* — Additon, Higgins & Pendleton, P.A.

(57) ABSTRACT

A printer is operable for marking an image on a media substrate. The printer includes a housing and a printhead. The printhead is operable for marking the image on a surface of the media substrate held in proximity therewith by a weight of a supply of the media substrate from which the media substrate is fed. The media substrate supply is disposed in the housing over the printhead.

23 Claims, 10 Drawing Sheets

(56) References Cited

U.S. PATENT DOCUMENTS 8,381,979 B2 2/2013 Franz
8,390,909 B2 3/2013 Plesko
8,408,464 B2 4/2013 Zhu et al.
8,408,468 B2 4/2013 Horn et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.
8,942,480 B2 1/2015 Ellis
8,944,313 B2 2/2015 Williams et al.
8,944,327 B2 2/2015 Meier et al.
8,944,332 B2 2/2015 Harding et al.
8,950,678 B2 2/2015 Germaine et al.
D723,560 S 3/2015 Zhou et al.
8,967,468 B2 3/2015 Gomez et al.
8,971,346 B2 3/2015 Sevier
8,976,030 B2 3/2015 Cunningham et al.
8,976,368 B2 3/2015 Akel et al.
8,978,981 B2 3/2015 Guan
8,978,983 B2 3/2015 Bremer et al.

(56) References Cited

U.S. PATENT DOCUMENTS 8,978,984 B2 3/2015 Hennick et al.
8,985,456 B2 3/2015 Zhu et al.
8,985,457 B2 3/2015 Soule et al.
8,985,459 B2 3/2015 Kearney et al.
8,985,461 B2 3/2015 Gelay et al.
8,988,578 B2 3/2015 Showering
8,988,590 B2 3/2015 Gillet et al.
8,991,704 B2 3/2015 Hopper et al.
8,996,194 B2 3/2015 Davis et al.
8,996,384 B2 3/2015 Funyak et al.
8,998,091 B2 4/2015 Edmonds et al.
9,002,641 B2 4/2015 Showering
9,007,368 B2 4/2015 Laffargue et al.
9,010,641 B2 4/2015 Qu et al.
9,015,513 B2 4/2015 Murawski et al.
9,016,576 B2 4/2015 Brady et al.
D730,357 S 5/2015 Fitch et al.
9,022,288 B2 5/2015 Nahill et al.
9,030,964 B2 5/2015 Essinger et al.
9,033,240 B2 5/2015 Smith et al.
9,033,242 B2 5/2015 Gillet et al.
9,036,054 B2 5/2015 Koziol et al.
9,037,344 B2 5/2015 Chamberlin
9,038,911 B2 5/2015 Xian et al.
9,038,915 B2 5/2015 Smith
D730,901 S 6/2015 Oberpriller et al.
D730,902 S 6/2015 Fitch et al.
D733,112 S 6/2015 Chaney et al.
9,047,098 B2 6/2015 Barten
9,047,359 B2 6/2015 Caballero et al.
9,047,420 B2 6/2015 Caballero
9,047,525 B2 6/2015 Barber
9,047,531 B2 6/2015 Showering et al.
9,049,640 B2 6/2015 Wang et al.
9,053,055 B2 6/2015 Caballero
9,053,378 B1 6/2015 Hou et al.
9,053,380 B2 6/2015 Xian et al.
9,057,641 B2 6/2015 Amundsen et al.
9,058,526 B2 6/2015 Powilleit
9,064,165 B2 6/2015 Havens et al.
9,064,167 B2 6/2015 Xian et al.
9,064,168 B2 6/2015 Todeschini et al.
9,064,254 B2 6/2015 Todeschini et al.
9,066,032 B2 6/2015 Wang
9,070,032 B2 6/2015 Corcoran
D734,339 S 7/2015 Zhou et al.
D734,751 S 7/2015 Oberpriller et al.
9,082,023 B2 7/2015 Feng et al.
9,224,022 B2 12/2015 Ackley et al.
9,224,027 B2 12/2015 Van Horn et al.
D747,321 S 1/2016 London et al.
9,230,140 B1 1/2016 Ackley
9,443,123 B2 1/2016 Hejl
9,250,712 B1 2/2016 Todeschini
9,258,033 B2 2/2016 Showering
9,262,633 B1 2/2016 Todeschini et al.
9,310,609 B2 4/2016 Rueblinger et al.
D757,009 S 5/2016 Oberpriller et al.
9,342,724 B2 5/2016 McCloskey
9,375,945 B1 6/2016 Bowles
D760,719 S 7/2016 Zhou et al.
9,390,596 B1 7/2016 Todeschini
D762,604 S 8/2016 Fitch et al.
D762,647 S 8/2016 Fitch et al.
9,412,242 B2 8/2016 Van Horn et al.
D766,244 S 9/2016 Zhou et al.
9,443,222 B2 9/2016 Singel et al.
9,478,113 B2 10/2016 Xie et al.
2006/0007295 A1* 1/2006 Ueda ..... B41J 2/325 347/217
2007/0063048 A1 3/2007 Havens et al.
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2010/0221054 A1 9/2010 Yamada et al.
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193423 A1 8/2012 Samek
2012/0203647 A1 8/2012 Smith
2012/0218366 A1* 8/2012 Yamada ..... B41J 2/355 347/194
2012/0223141 A1 9/2012 Good et al.
2013/0043312 A1 2/2013 Van Horn
2013/0075168 A1 3/2013 Amundsen et al.
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0287258 A1 10/2013 Kearney
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedraro
2013/0307964 A1 11/2013 Bremer et al.
2013/0308625 A1 11/2013 Park et al.
2013/0313324 A1 11/2013 Koziol et al.
2013/0313325 A1 11/2013 Wilz et al.
2013/0342717 A1 12/2013 Havens et al.
2014/0001267 A1 1/2014 Giordano et al.
2014/0002828 A1 1/2014 Laffargue et al.
2014/0008439 A1 1/2014 Wang
2014/0025584 A1 1/2014 Liu et al.
2014/0100813 A1 1/2014 Showering
2014/0034734 A1 2/2014 Sauerwein
2014/0036848 A1 2/2014 Pease et al.
2014/0039693 A1 2/2014 Havens et al.
2014/0042814 A1 2/2014 Kather et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078341 A1 3/2014 Havens et al.
2014/0078342 A1 3/2014 Li et al.
2014/0078345 A1 3/2014 Showering
2014/0098792 A1 4/2014 Wang et al.
2014/0100774 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0104451 A1 4/2014 Todeschini et al.
2014/0106594 A1 4/2014 Skvoretz
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0124577 A1 5/2014 Wang et al.
2014/0124579 A1 5/2014 Ding
2014/0125842 A1 5/2014 Winegar
2014/0125853 A1 5/2014 Wang
2014/0125999 A1 5/2014 Longacre et al.
2014/0129378 A1 5/2014 Richardson
2014/0131438 A1 5/2014 Kearney
2014/0131441 A1 5/2014 Nahill et al.
2014/0131443 A1 5/2014 Smith
2014/0131444 A1 5/2014 Wang
2014/0131445 A1 5/2014 Ding et al.
2014/0131448 A1 5/2014 Xian et al.
2014/0133379 A1 5/2014 Wang et al.

(56) References Cited

U.S. PATENT DOCUMENTS

2014/0136208 A1 5/2014 Maltseff et al.
2014/0140585 A1 5/2014 Wang
2014/0151453 A1 6/2014 Meier et al.
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0166759 A1 6/2014 Liu et al.
2014/0168787 A1 6/2014 Wang et al.
2014/0175165 A1 6/2014 Havens et al.
2014/0175172 A1 6/2014 Jovanovski et al.
2014/0191644 A1 7/2014 Chaney
2014/0191913 A1 7/2014 Ge et al.
2014/0197238 A1 7/2014 Lui et al.
2014/0197239 A1 7/2014 Havens et al.
2014/0197304 A1 7/2014 Feng et al.
2014/0203087 A1 7/2014 Smith et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0232930 A1 8/2014 Anderson
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0284384 A1 9/2014 Lu et al.
2014/0288933 A1 9/2014 Braho et al.
2014/0297058 A1 10/2014 Barker et al.
2014/0299665 A1 10/2014 Barber et al.
2014/0312121 A1 10/2014 Lu et al.
2014/0319220 A1 10/2014 Coyle
2014/0319221 A1 10/2014 Oberpriller et al.
2014/0326787 A1 11/2014 Barten
2014/0332590 A1 11/2014 Wang et al.
2014/0344943 A1 11/2014 Todeschini et al.
2014/0346233 A1 11/2014 Liu et al.
2014/0351317 A1 11/2014 Smith et al.
2014/0353373 A1 12/2014 Van Horn et al.
2014/0361073 A1 12/2014 Qu et al.
2014/0361082 A1 12/2014 Xian et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0001304 A1 1/2015 Todeschini
2015/0003673 A1 1/2015 Fletcher
2015/0009338 A1 1/2015 Laffargue et al.
2015/0009610 A1 1/2015 London et al.
2015/0014416 A1 1/2015 Kotlarsky et al.
2015/0021397 A1 1/2015 Rueblinger et al.
2015/0028102 A1 1/2015 Ren et al.
2015/0028103 A1 1/2015 Jiang
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0048168 A1 2/2015 Fritz et al.
2015/0049347 A1 2/2015 Laffargue et al.
2015/0051992 A1 2/2015 Smith
2015/0053766 A1 2/2015 Havens et al.
2015/0053768 A1 2/2015 Wang et al.
2015/0053769 A1 2/2015 Thuries et al.
2015/0062366 A1 3/2015 Liu et al.
2015/0063215 A1 3/2015 Wang
2015/0063676 A1 3/2015 Lloyd et al.
2015/0069130 A1 3/2015 Gannon
2015/0071819 A1 3/2015 Todeschini
2015/0083800 A1 3/2015 Li et al.
2015/0086114 A1 3/2015 Todeschini
2015/0088522 A1 3/2015 Hendrickson et al.
2015/0096872 A1 4/2015 Woodburn
2015/0099557 A1 4/2015 Pettinelli et al.
2015/0100196 A1 4/2015 Hollifield
2015/0102109 A1 4/2015 Huck
2015/0115035 A1 4/2015 Meier et al.
2015/0127791 A1 5/2015 Kosecki et al.
2015/0128116 A1 5/2015 Chen et al.
2015/0129659 A1 5/2015 Feng et al.
2015/0133047 A1 5/2015 Smith et al.
2015/0134470 A1 5/2015 Hejl et al.
2015/0136851 A1 5/2015 Harding et al.
2015/0136854 A1 5/2015 Lu et al.
2015/0142492 A1 5/2015 Kumar
2015/0144692 A1 5/2015 Hejl
2015/0144698 A1 5/2015 Teng et al.
2015/0144701 A1 5/2015 Xian et al.
2015/0149946 A1 5/2015 Benos et al.
2015/0161429 A1 6/2015 Xian
2015/0169925 A1 6/2015 Chang et al.
2015/0169929 A1 6/2015 Williams et al.
2015/0186703 A1 7/2015 Chen et al.
2015/0193644 A1 7/2015 Kearney et al.
2015/0193645 A1 7/2015 Colavito et al.
2015/0199957 A1 7/2015 Funyak et al.
2015/0204671 A1 7/2015 Showering
2015/0210199 A1 7/2015 Payne
2015/0220753 A1 8/2015 Zhu et al.
2015/0254485 A1 9/2015 Feng et al.
2015/0327012 A1 11/2015 Bian et al.
2016/0014251 A1 1/2016 Hejl
2016/0040982 A1 2/2016 Li et al.
2016/0042241 A1 2/2016 Todeschini
2016/0057230 A1 2/2016 Todeschini et al.
2016/0109219 A1 4/2016 Ackley et al.
2016/0109220 A1 4/2016 Laffargue
2016/0109224 A1 4/2016 Thuries et al.
2016/0112631 A1 4/2016 Ackley et al.
2016/0112643 A1 4/2016 Laffargue et al.
2016/0124516 A1 5/2016 Schoon et al.
2016/0125217 A1 5/2016 Todeschini
2016/0125342 A1 5/2016 Miller et al.
2016/0125873 A1 5/2016 Braho et al.
2016/0133253 A1 5/2016 Braho et al.
2016/0136964 A1* 5/2016 Howarth ..... B41J 2/32
347/197
2016/0171720 A1 6/2016 Todeschini
2016/0178479 A1 6/2016 Goldsmith
2016/0180678 A1 6/2016 Ackley et al.
2016/0189087 A1 6/2016 Morton et al.
2016/0227912 A1 8/2016 Oberpriller et al.
2016/0232891 A1 8/2016 Pecorari
2016/0292477 A1 10/2016 Bidwell
2016/0294779 A1 10/2016 Yeakley et al.
2016/0306769 A1 10/2016 Kohtz et al.
2016/0314276 A1 10/2016 Sewell et al.
2016/0314294 A1 10/2016 Kubler et al.

FOREIGN PATENT DOCUMENTS

WO 2014019130 A1 2/2014
WO 2014110495 A1 7/2014

OTHER PUBLICATIONS

U.S. Appl. No. 29/525,068 for Tablet Computer With Removable Scanning Device filed Apr. 27, 2015 (Schulte et al.); 19 pages.
U.S. Appl. No. 29/468,118 for an Electronic Device Case, filed Sep. 26, 2013 (Oberpriller et al.); 44 pages.
U.S. Appl. No. 29/530,600 for Cyclone filed Jun. 18, 2015 (Vargo et al); 16 pages.
U.S. Appl. No. 14/707,123 for Application Independent DEX/UCS Interface filed May 8, 2015 (Pape); 47 pages.

(56) References Cited

OTHER PUBLICATIONS

U.S. Appl. No. 14/283,282 for Terminal Having Illumination and Focus Control filed May 21, 2014 (Liu et al.); 31 pages; now abandoned.
U.S. Appl. No. 14/705,407 for Method and System to Protect Software-Based Network-Connected Devices From Advanced Persistent Threat filed May 6, 2015 (Hussey et al.); 42 pages.
U.S. Appl. No. 14/704,050 for Intermediate Linear Positioning filed May 5, 2015 (Charpentier et al.); 60 pages.
U.S. Appl. No. 14/705,012 for Hands-Free Human Machine Interface Responsive to a Driver of a Vehicle filed May 6, 2015 (Fitch et al.); 44 pages.
U.S. Appl. No. 14/715,672 for Augumented Reality Enabled Hazard Display filed May 19, 2015 (Venkatesha et al.); 35 pages.
U.S. Appl. No. 14/735,717 for Indicia-Reading Systems Having an Interface With a User's Nervous System filed Jun. 10, 2015 (Todeschini); 39 pages.
U.S. Appl. No. 14/702,110 for System and Method for Regulating Barcode Data Injection Into a Running Application on a Smart Device filed May 1, 2015 (Todeschini et al.); 38 pages.
U.S. Appl. No. 14/747,197 for Optical Pattern Projector filed Jun. 23, 2015 (Thuries et al.); 33 pages.
U.S. Appl. No. 14/702,979 for Tracking Battery Conditions filed May 4, 2015 (Young et al.); 70 pages.
U.S. Appl. No. 29/529,441 for Indicia Reading Device filed Jun. 8, 2015 (Zhou et al.); 14 pages.
U.S. Appl. No. 14/747,490 for Dual-Projector Three-Dimensional Scanner filed Jun. 23, 2015 (Jovanovski et al.); 40 pages.
U.S. Appl. No. 14/740,320 for Tactile Switch Fora Mobile Electronic Device filed Jun. 16, 2015 (Barndringa); 38 pages.
U.S. Appl. No. 14/740,373 for Calibrating a Volume Dimensioner filed Jun. 16, 2015 (Ackley et al.); 63 pages.
U.S. Appl. No. 13/367,978, filed Feb. 7, 2012, (Feng et al.); now abandoned.
U.S. Appl. No. 14/277,337 for Multipurpose Optical Reader, filed May 14, 2014 (Jovanovski et al.); 59 pages; now abandoned.
U.S. Appl. No. 14/446,391 for Multifunction Point of Sale Apparatus With Optical Signature Capture filed Jul. 30, 2014 (Good et al.); 37 pages; now abandoned.
U.S. Appl. No. 29/516,892 for Table Computer filed Feb. 6, 2015 (Bidwell et al.); 13 pages.
U.S. Appl. No. 29/523,098 for Handle for a Tablet Computer filed Apr. 7, 2015 (Bidwell et al.); 17 pages.
U.S. Appl. No. 29/528,890 for Mobile Computer Housing filed Jun. 2, 2015 (Fitch et al.); 61 pages.
U.S. Appl. No. 29/526,918 for Charging Base filed May 14, 2015 (Fitch et al.); 10 pages.
Extended Search Report in related European Application No. 17188052.9 dated Jan. 8, 2018, pp. 1-9.

* cited by examiner

ULTRA COMPACT PRINTER

TECHNOLOGY FIELD

The present invention relates generally to printing. More particularly, example embodiments of the present invention relate to a printer apparatus.

BACKGROUND

Generally speaking, a printing apparatus ("printer") is operable for marking image(s) upon graphic media substrates to produce graphic media products such as labels, decals, emblems, and signs. The image may comprise symbols, data patterns, text, indicia, and other markings. The markings present information graphically to users, who view the graphic media products.

The media substrate comprises a material that may be marked durably with the image using a marking agent compatible therewith. Simple paper substrates, for example, may be simply marked with an ink. Graphic media products, such as some labels marked with barcodes or other data patterns, may comprise a thermally sensitive substrate material and marking agent.

Printers may comprise a printhead mechanism and a feeder mechanism. The printhead is operable for the marking of the image onto a substantially blank portion of the media substrate. The feeder is operable for moving the blank media substrate into proximity and alignment with the printhead sufficient for the marking of the image onto the substrate.

The operation of the feeder comprises applying a mechanical force to a supply of the blank substrate. For example, the substrate may be supplied as a roll of blank thermally sensitive material in a web configuration disposed on a spool. The feeder may apply a traction to a roll, with which the substrate is fed to the printhead.

Printers are designed and constructed with sizes sufficient to accommodate the mechanical operations of components of the feeder mechanism and the supply of the blank media substrate, as well as the printhead and its other electrical and mechanical components. The size of the printer relates to the spatial area it may cover upon its deployment.

Relative to a finite amount of space that may be available in a facility in which the printer may be deployed, the printer size may be significant. For example, real estate costs associated with the facility relate to its total area, and the space occupied by the printer becomes unavailable for other, perhaps more productive or remunerative use.

Heavy duty, high throughput printers intended for industrial use may be constructed using larger and more numerous components, and are thus typically larger than other printers. Especially in relation to the industrial printers, their size may thus occupy more than a trivial amount of the available area, with higher related cost.

Moreover, the size of a printer corresponds to the size and number of its components and thus, to the amount of material used in its construction and its weight. Relative to smaller printers, larger printers comprise more material, and are thus heavier. The size and weight of a printer relates directly to its cost of construction, procurement, transport, and operation.

The higher number of components also contributes directly to the complexity of the printers. The complexity of the printers relates inversely to their reliability, while contributing directly to their maintenance expectations, including associated downtime, each of which may relate to corresponding loss of productivity and additional expense.

In relation to the printers discussed above (referred to herein as "conventional"), therefore, it could be useful to generally reduce their size and the amount of material used in their fabrication. It could also thus be useful to generally reduce the number of components the printers comprise and the complexity associated therewith, while increasing their reliability. Further, it could thus be useful to reduce the costs associated with the printers relating to their size, amount of material and number of components, complexity, and/or maintenance expectations, downtime, and lost productivity.

SUMMARY

Accordingly, in one aspect, an example embodiment of the present invention relates to a printer comprising a small size, amount of material, number of components, and complexity, relative, for example, to conventional printers. The relatively simple printers associated with example embodiments of the present invention also comprise a correspondingly higher reliability level. The relatively less material, fewer components, and lower complexity of the printers implemented according to example embodiments, further, may reduce costs associated with their fabrication, procurement, and maintenance.

An example embodiment of the present invention relates to a printer. The printer is operable for marking an image on a media substrate. The printer comprises a housing and a printhead. The printhead is operable for marking an image on a surface of a media substrate held in proximity therewith by a weight of a supply of the media substrate from which the media substrate is fed. The media substrate supply is disposed in the housing over the printhead.

An example embodiment of the present invention relates to a method for printing a graphic media product. The method comprises moving a media substrate from a supply thereof, the supply supported vertically between a bottom of a housing of a printer and a top of the printer housing, over a printhead of the printer. A weight of the media substrate supply displaces a portion of the surface of the media substrate longitudinally over the printhead and into proximity therewith. The method also comprises marking an image on the portion of the media substrate placed into proximity with the printhead. The printing method may be performed by the printer, described herein.

An example embodiment of the present invention relates to a graphic media product produced by a printing process. The graphic media product comprises an image marked on a media substrate. The printing process may relate to the method for printing a graphic media product, described herein. The printing process may be performed by the printer apparatus, described herein.

The foregoing illustrative summary, as well as other example features, functions and/or aspects or features of embodiments of the invention, and the manner in which the same may be implemented or accomplished, are further explained within the following detailed description of example embodiments and each figure ("FIG.") of the accompanying drawings referred to therein.

DESCRIPTION OF EXAMPLE EMBODIMENTS

Figure 1:
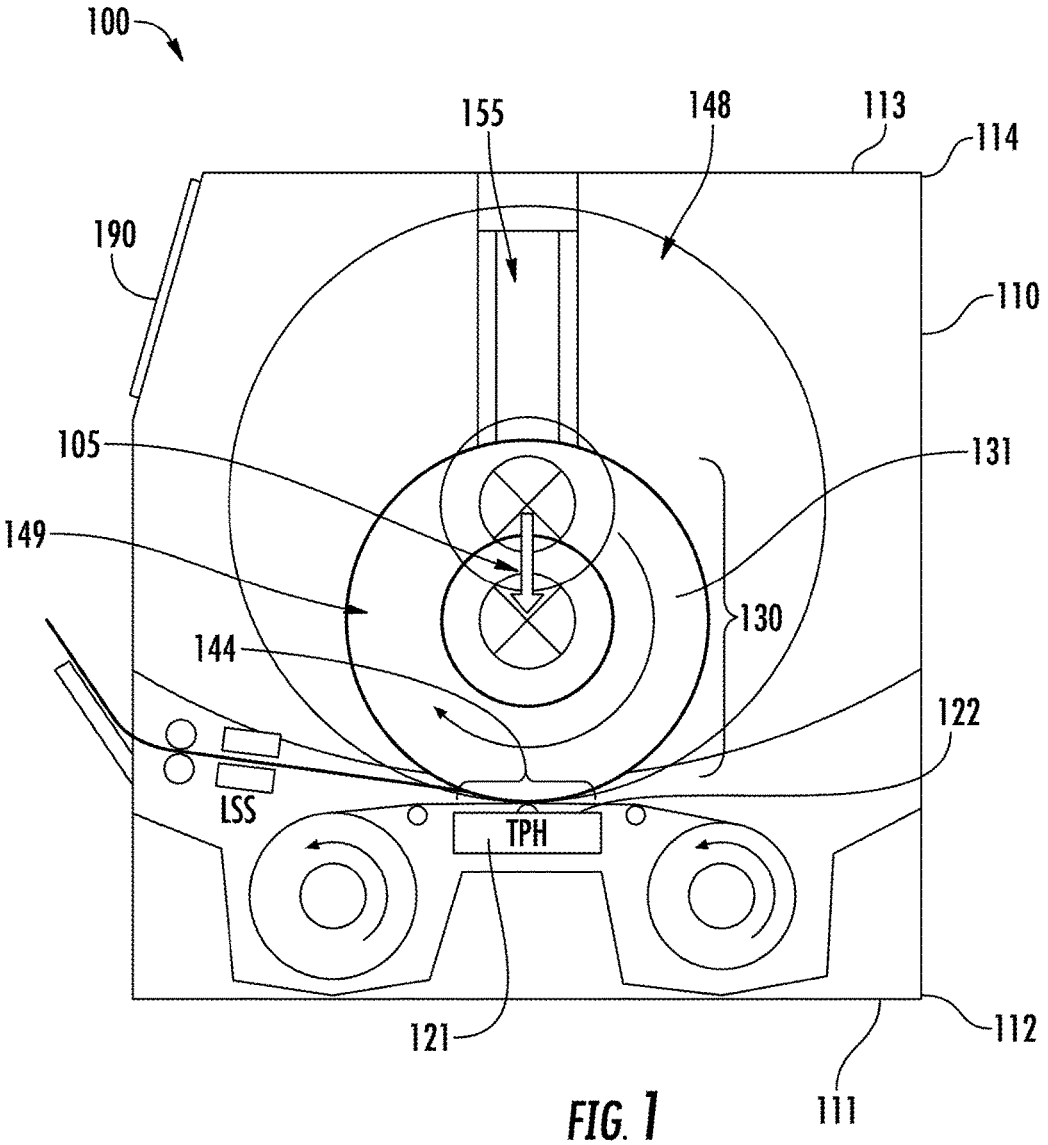
FIG. 1 depicts an example printer apparatus, according to an embodiment of the present invention.

Example embodiments of the present invention are described in relation to a printer. The printer comprises an apparatus, which is operable for printing an image on a media substrate. The printer apparatus comprises a housing and a printhead. The printhead is operable for marking an image on a surface of a media substrate held in proximity therewith by a weight of a supply of the media substrate from which the media substrate is fed. The media substrate supply is disposed in the housing over the printhead.

Embodiments of the present invention may thus be useful, for example, with printers that comprise a small size, amount of material, number of components, and complexity, relative, for example, to conventional printers. The relatively simple printers associated with example embodiments of the present invention also comprise a correspondingly higher reliability level. The relatively less material, fewer components, and lower complexity of the printers implemented according to example embodiments, further, may reduce costs associated with their fabrication, procurement, and maintenance.

Overview.

An example embodiment of the present invention relates to a printer. The printer is operable for marking an image on a media substrate. The printer comprises a housing, and a printhead. The printhead is operable for marking an image on a surface of a media substrate held in proximity therewith by a weight of a supply of the media substrate from which the media substrate is fed. The media substrate supply is disposed in the housing over the printhead.

The printhead may comprise a thermal printhead (TPH), and the media substrate may comprise a thermally sensitive markable material compatible with the TPH. The media substrate is fed from the supply thereof over a portion of the TPH operable for the marking of the image. The thermally sensitive markable material may comprises one or more of a thermally sensitive medium disposed in web related configuration, or a thermal transfer medium disposed in a ribbon related configuration. The TPH may comprise a plurality of electrically resistive elements disposed in a linear array configured in a horizontal orientation perpendicular to a direction in which the media substrate is fed.

The image may comprise a plurality of picture elements (pixels) marked upon the media surface. Each of the pixels corresponds to a point disposed spatially at a discrete position on a burn line. The burn line corresponds to the horizontal orientation of the linear array of the resistive elements. The pixel is positioned on the burn line, based on a controllable energization state of one of the resistive elements. The burn line runs parallel to one or more burn lines disposed successively in the perpendicular horizontal orientation.

Each of the pixels comprises at least a brightness characteristic contrasting controllably with a brightness characteristic of a background area of the media substrate surface proximate thereto. The marking of the image comprises heating one or more locations disposed over the burn line, controllably, based on one or more of an input to the printer. The printer input relates to one or more of graphic data corresponding to the image, a stored instance of the image, or a programmed instance of the image.

In an example embodiment, the image may comprise a marking agent compatible with a material property of the media substrate. The marking agent is deposited controllably with the printhead over one or more spatial portions of a surface of the media substrate, based on one or more of an input to the printer. The printer input relates to one or more of graphic data corresponding to the image, a stored instance of the image, or a programmed instance of the image.

The printer may further comprise a feed mechanism operable for moving the media substrate from the supply thereof to the printhead. The moving of the media substrate comprises applying one or more of a traction, or a mechanical force to the media substrate. The mechanical force may comprise one or more of a tension or a friction applied to the media substrate in the direction of the moving thereof.

An example embodiment may be implemented in which the feed mechanism comprises a pair of rollers operable for the applying the mechanical force to the media substrate. The rollers may comprise platen rollers. The roller pair comprises a lower roller, and an upper roller disposed over the lower roller, relative to a top of the housing and/or a bottom thereof. The media substrate is drawn between the lower roller and the upper roller.

The printer may further comprise at least one sensor disposed downstream of the pair of rollers, relative to the moving of the media substrate. The at least one sensor is operable for detecting a longitudinal position of at least a portion of the media substrate relative to the direction of the moving thereof. The at least one sensor comprises one or more of a reflection based sensor or a pair of label stop sensors.

The reflection based sensor device is operable electro-optically for detecting a reflection of light from the surface of the media substrate illuminated therewith and corresponding spatially to the longitudinal position of the media substrate portion. The pair of label stop sensor (LSS) devices comprises a lower LSS device, and an upper LSS device disposed over the lower LSS device, relative to the top and/or the bottom of the housing. Upon the moving of the media substrate, at least a portion of the media substrate is drawn between the lower LSS device and the upper LSS device. An example embodiment may be implemented in which the media substrate supply is loadable into the housing based, at least partially, on a displacement of the upper roller and the upper LSS device vertically towards the top of the housing.

The media substrate comprises a material compatibly markable with the printhead and configured, prior to the moving thereof, as a roll disposed on a spool. Upon the moving of the media substrate, the media substrate portion is drawn from the spool in the direction of the movement and in one or more of a web configuration or a ribbon configuration.

The printer may further comprise a hanger, which is disposed movably between the top and the bottom of the housing. The hanger is operable for suspending the media substrate supply, vertically against the weight thereof, and operably over the printhead. The hanger is thus operable for the suspending of the media substrate supply over the marking of the image on the media substrate surface, the movement of the media substrate surface over the printhead, a consumption of the media substrate supply related to one or more of the moving thereof or the marking of the image, and/or a reduction in the weight of the media substrate supply, which corresponds to the consumption thereof.

The printer may further comprise a print pressure adjustment mechanism (PPAM). The PPAM is operable for controlling the printhead in relation to adjusting the marking of the image on the media substrate based on a degree of consumption related to the supply of the media substrate. The printer may further comprise a media use detector operable with the PPAM and operable for detecting the degree of consumption of the media substrate supply.

The detecting of the degree of consumption of the media substrate supply may be based on a monitoring of a remainder of the media substrate supply by the feed mechanism and/or a controller associated with an operation of the feed mechanism. The detecting of the degree of consumption of the media substrate supply may be performed with an electromechanical operation and/or an electro-optical operation of the media use detector.

An example embodiment of the present invention relates to a method for printing a graphic media product. The graphic media product comprises an image marked on a media substrate. The method comprises moving the media substrate, and marking the image onto the media substrate. The media substrate is moved from a supply thereof, over a printhead of the printer. The media substrate supply is supported vertically between a bottom of a housing of a printer and a top of the printer housing. A weight of the media substrate supply places a portion of the surface of the media substrate longitudinally over the printhead and into proximity therewith. The image is marked on the portion of the media substrate placed into proximity with the printhead.

An example embodiment of the present invention relates to a graphic media product produced by a printing process. The printing process may relate to the method for printing a graphic media product, described herein. The printing process may be performed by the printer apparatus, described herein.

Example Printer Apparatus.

An example embodiment of the present invention relates to a printer apparatus operable for marking an image on a media substrate. FIG. 1 depicts an example printer apparatus 100, according to an embodiment of the present invention. The printer apparatus ("printer") comprises a housing 110. The housing 110 provides a support structure for the printer 100.

The housing 110 has a bottom 111 oriented at least partially in relation to a first, lower plane 112, and a top 113 oriented at least partially in relation to a second plane 114, opposite from the first, lower plane 112.

A printhead mechanism 121 is disposed proximate to the bottom 111 and has a marking surface 122 facing upward, toward the top 113. The marking surface 122 is operable for the marking of the image.

A supply 130 of the media substrate 131 is disposed over the printhead 121, with a markable surface of the substrate 121 placed in a contact, vertically, with the printhead marking surface 122 by its weight. The media substrate supply 130 is supported by media hanger 105.

In an example embodiment, the media substrate portion 144 is held in contact with the marking surface 122 by the weight of the media substrate supply 130, based on the force of gravity acting upon the mass thereof. The media substrate supply 130 may be configured as a roll of the media substrate 131 disposed on a spool. The spool may be mounted on the hanger 105. The spool may rotate upon the hanger 105, and/or the hanger 105 may be rotatable within the hanger guide 155.

An example embodiment of the present invention may be implemented in which the marked surface 122 of the media substrate is disposed in an orientation, which may be considered unique in relation to some conventional printers. For example, some printers may mark the surface of graphic media substrates in a configuration that may be considered "upside-down," in relation to the orientation of the surface 122 of the media substrate, as handled and marked by the printer 100 described herein.

The printer 100 may also comprise a user interface (UI) and/or liquid crystal display (LCD) 190 (or another kind of display). The UI and/or display 190 may be associated with an electronic control system of the printer 100. A graphic user interface (GUI) may be implemented with a UI, which is operable with the display.

Figure 2A:
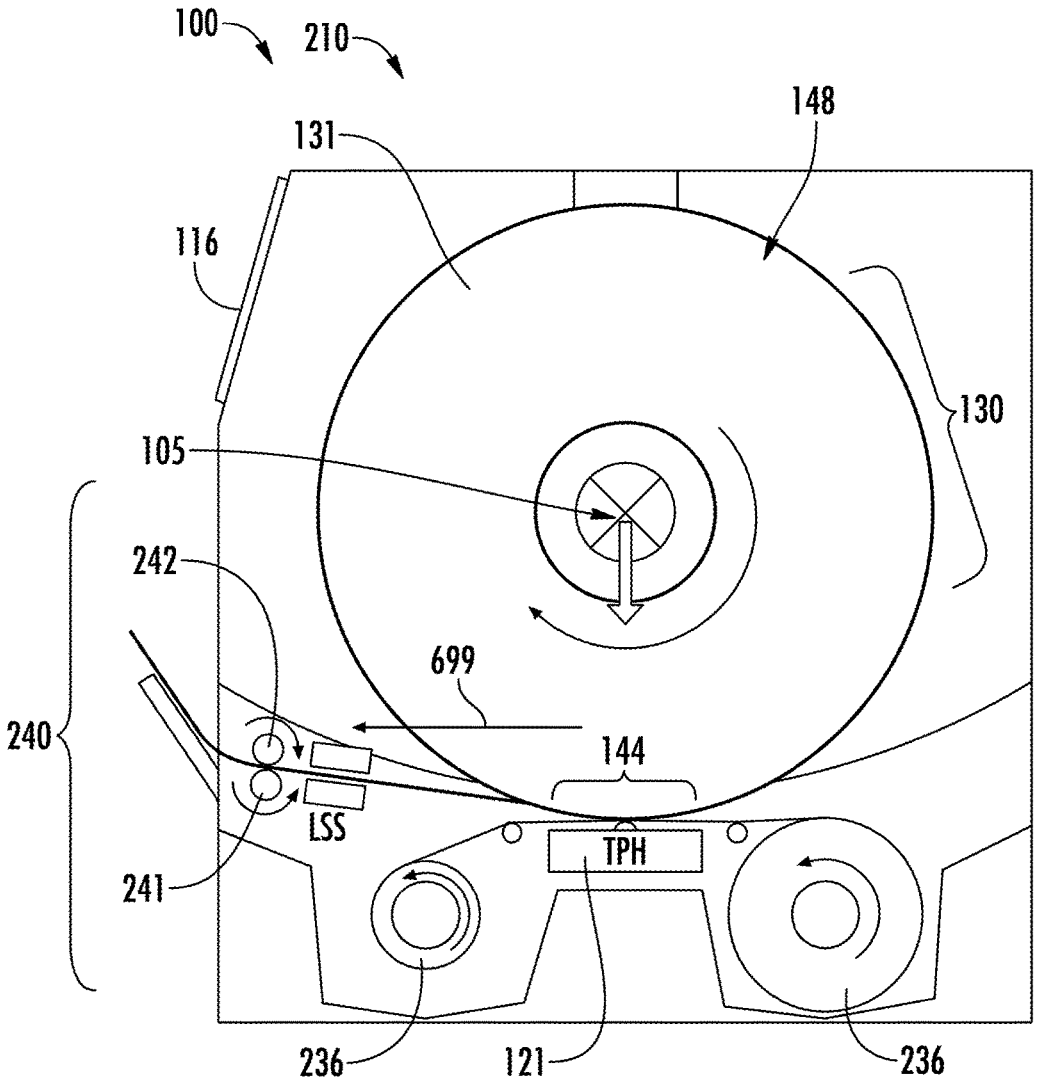
FIG. 2A depicts an example configuration of the printer with a full media substrate supply, according to an embodiment of the present invention.

FIG. 2A depicts an example configuration 210 of the printer 100 with a full media substrate supply 130, according to an embodiment of the present invention. A feed mechanism 240 is operable for moving the media substrate 131. The media substrate portion 144 is displaced longitudinally over the marking surface 122 of the printhead 121.

The feed mechanism 240 may be operable for the moving the media substrate using a mechanical force applied to the media substrate 130. The mechanical force may comprise a traction applied longitudinally to the media substrate 130.

The feed mechanism 240 may comprise a pair of platen rollers operable for the applying the mechanical force to the media substrate 131. The platen roller pair 240 comprises a first platen roller 241, and a second platen roller 242 disposed over the first platen roller 241 relative to the top and bottom of the housing 110.

The media substrate 130 is drawn between the first platen roller 241 and the second platen roller 242. One or more of the platen rollers 241 or 242 may be rotated by a motor, and/or a gear assembly coupled mechanically thereto, in a direction to cause a translational displacement of the media substrate 130 in a direction 699 of feeding and marking. Each of the platen rollers of the pair 240 is compressed against the other, to apply the traction to the media substrate 130 by friction and rotation as it passes between them.

The media substrate 131 comprises a material compatibly markable with the printhead mechanism 121. The media substrate 130 may be configured, prior to the moving of the portion 144 thereof, supplied as a roll disposed on a spool 130. Upon the moving of the media substrate 130, the media substrate portion 144 is drawn longitudinally from the spool 130 in a web configuration. A longitudinal dimension of the web configuration of the media substrate 130 exceeds, significantly, a lateral dimension thereof.

In an example embodiment, the printhead 121 comprises a thermal printhead (TPH) and the media substrate 130 comprises a thermally sensitive material. The TPH comprises a marking surface 122 operable for the marking of the image thermally onto the thermally sensitive media substrate. The marking surface 122 comprises a plurality of electrically resistive elements, each of which may be controllably heated. A marking material compatible with the thermally sensitive material of the substrate 130 comprises a thermally printable film or ribbon material 236. As the media substrate portion 144 moves across the TPH 121, the thermally printable ribbon is drawn therewith, e.g., from a supply spool to a take-up spool, each disposed on opposite sides of the TPH 121.

The TPH marking surface 122 comprises a burn line. The marking of the image comprises the moving of the portion 144 of the marking surface of the thermally sensitive media substrate over the burn line. As the substrate is moved over the burn line, the TPH is operable for controllably heating localized positions on the surface of the substrate, and thus, marks a portion of the image at each of the controllably heated positions. The controllable marking of the image portions by the TPH may comprise heating one or more locations disposed over the marking surface, controllably, based on one or more of an input to the printer related to the image, or a stored or programmed instance thereof. The input and/or stored or programmed instance may comprise instructions, physically (e.g., electronically, optically, electromagnetically, etc.) stored with a non-transitory computer-readable storage medium. A marking material is transferred from the marking ribbon 236 to each of the controllably heated locations of the substrate 130.

Figure 2B:
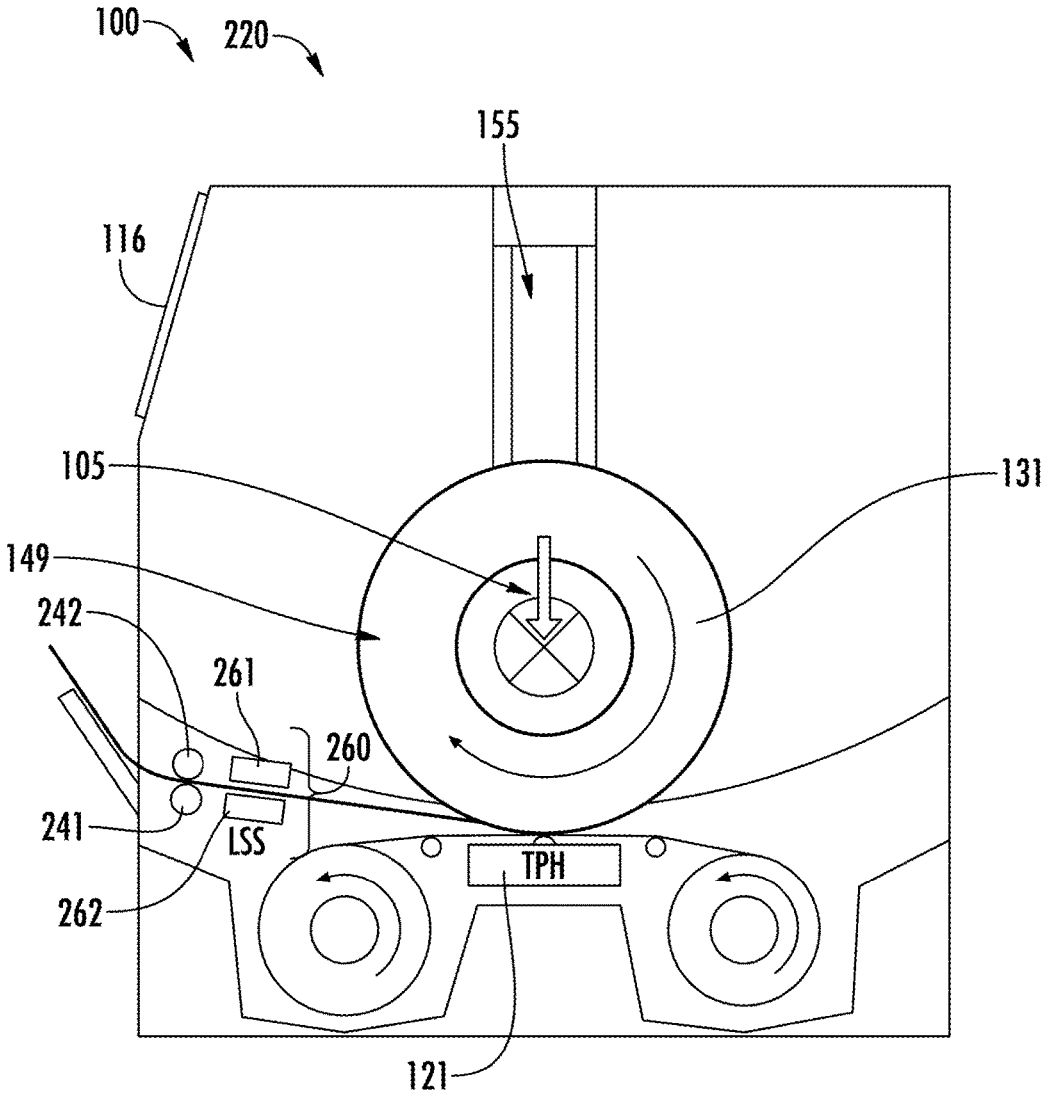
FIG. 2B depicts an example configuration of the printer with a partially depleted media substrate supply, according to an embodiment of the present invention.

FIG. 2B depicts an example configuration 220 of the printer with a partially depleted media substrate supply, according to an embodiment of the present invention.

The printer apparatus 100 may further comprise a pair of label stop sensor (LSS) devices 260 disposed downstream of the pair of platen rollers 240, relative to the longitudinal displacement of the media substrate portion. The LSS devices 240 are operable for detecting a position of the media substrate portion. The pair of LSS devices 240 comprises a first LSS device 241, and a second LSS device 242 disposed over the first LSS device 241, relative to the top and bottom of the housing, and on opposite sides of the substrate 130, downstream from the TPH 121. The media substrate 130 is drawn, e.g., during the movement thereof, between the first LSS device 261 and the second LSS device 262.

In an example embodiment, the printer apparatus further comprises a hanger 105. The hanger 105 is disposed movably between the top 113 and the bottom 111 of the housing 110, e.g., within a hanger guide 155. The hanger 105 is operable for moveably suspending the media substrate supply 131, vertically against its own weight, over the printhead 121 and in the contact with the marking surface 122 thereof. The hanger 105 supports the weight of the media substrate supply 131 upon its loading into the printer 100, and at every stage of its use or consumption, until it is depleted and/or ready to be replaced.

The hanger 105 is operable for suspending the media substrate supply 131, with the substrate 130 in contact with the marking surface 122 of the printhead 121, upon loading of the substrate supply 130 and during the marking of the image on the media substrate 130, the longitudinal displacement of the markable surface of the portion 144 thereof over the printhead 121 marking surface 122, a consumption or use of the supply 131 of the media substrate 130 related to the marking of the image thereon, and/or a reduction in the weight of the media substrate supply 130 corresponding to the use or consumption of the substrate 130 thereof. The hanger 105 moves down within the hanger guide 155 as the substrate 130 is consumed by a printing process.

Figure 3:
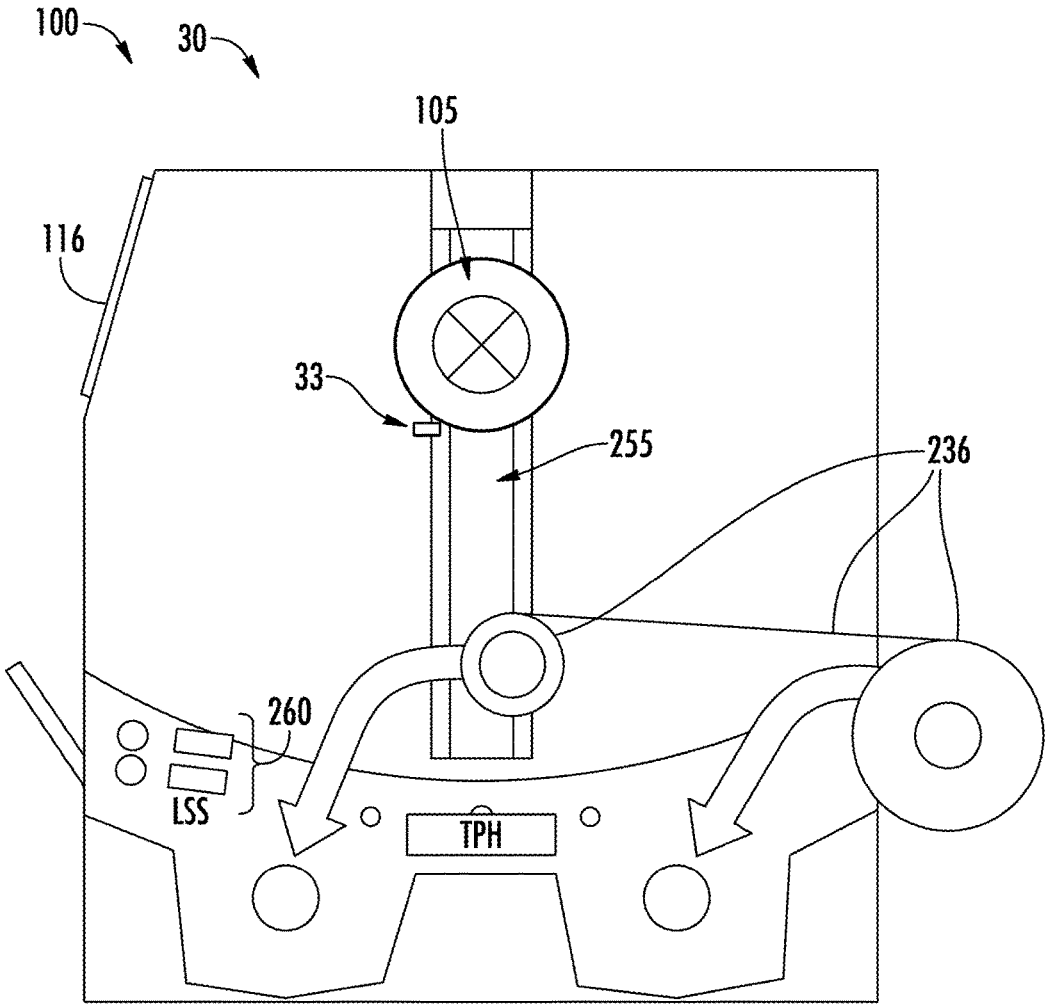
FIG. 3 depicts an example configuration of the printer in preparation for loading a thermal marking material and/or media substrate supply, according to an embodiment of the present invention.
Figure 4:
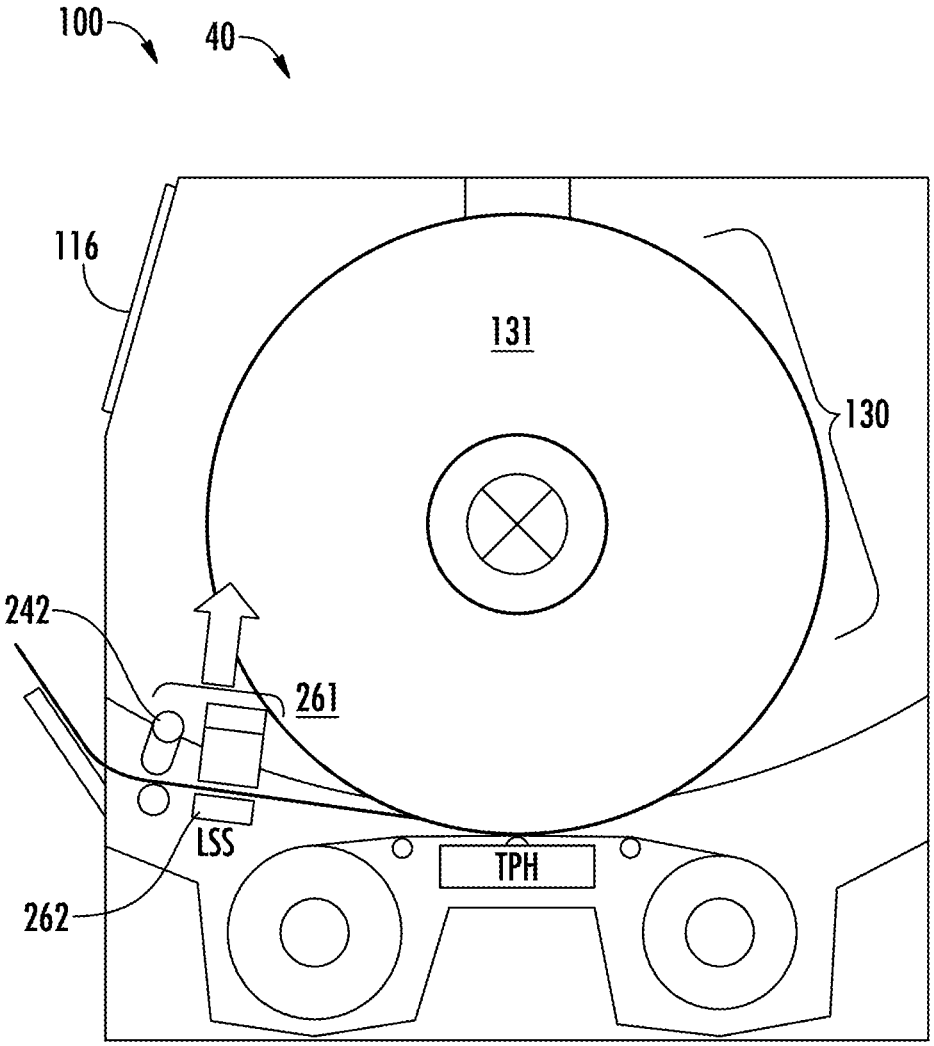
FIG. 4 depicts an example configuration of the printer upon loading the media substrate supply, according to an embodiment of the present invention.

The media substrate supply 130 may be loadable into the printer 100. FIG. 3 depicts an example configuration 30 of the printer 100 in preparation for a loading of the supply 131 of the media substrate 130 and/or loading of the thermal marking material 236, according to an embodiment of the present invention. FIG. 4 depicts an example configuration 40 of the printer apparatus 100 upon loading the media substrate supply 131, according to an embodiment of the present invention.

In an example embodiment, the loading of the substrate supply 131 is based, at least in part, on a displacement of the second platen roller 242, and the second LSS detector 241 vertically towards the top 113 of the housing 110. Further, loading of new thermal transfer marking ribbon 236 may be facilitated by locking the hanger 105 in a position proximate to the top 113 of the housing 110, using a locking pin 33.

Figure 5A:
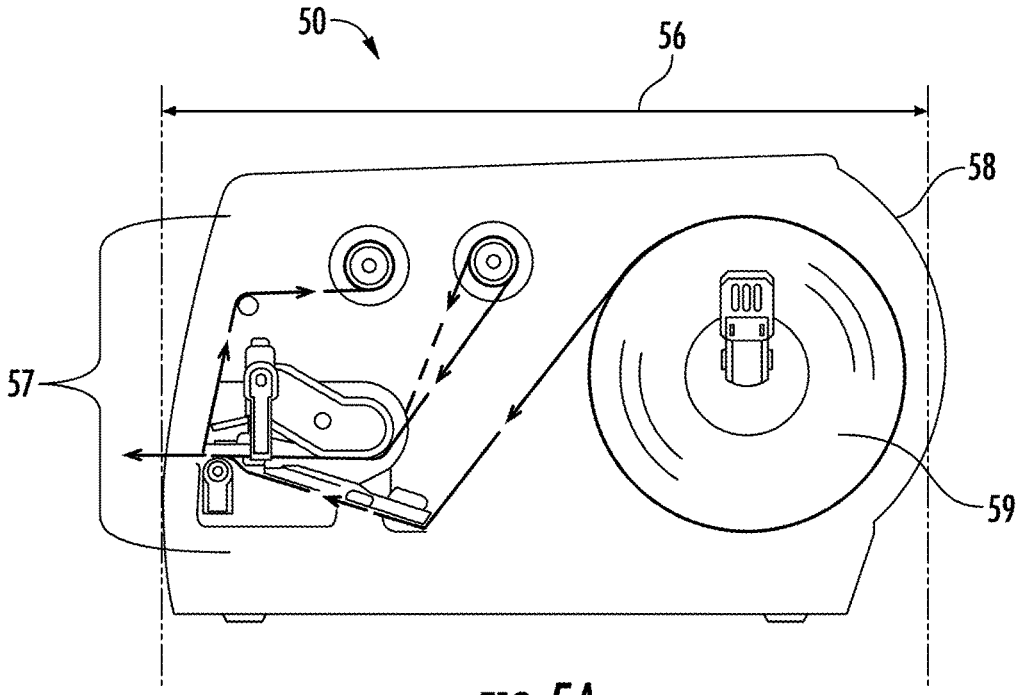
FIG. 5A depicts example contour of the printer, according to an embodiment of the present invention.
Figure 5B:
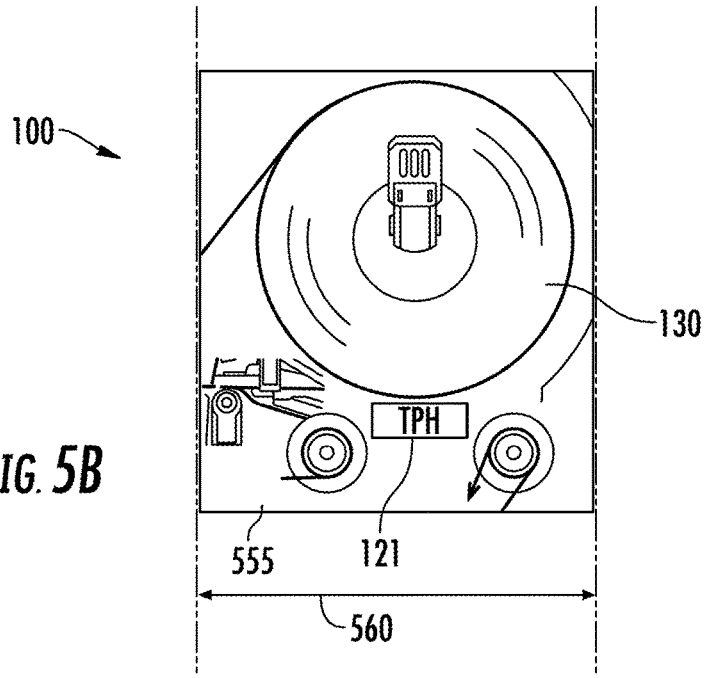
FIG. 5B depicts a typical contour of a conventional printer, for contrast with the contour of a printer configured according to an embodiment of the present invention.

FIG. 5B depicts example contour of the printer apparatus 100, according to an embodiment of the present invention. An example embodiment may be implemented in which the housing 110 comprises, at least in part, a housing 555. The media substrate 130 and components of the printer 100, e.g., the TPH 121, may be disposed within the housing 555. The printer apparatus 100 and, e.g., the housing 555 thereof, comprise a characteristic dimension 'A' 560. Relative to the dimension characteristic 560 of the printer 100, typical conventional printers may comprise larger dimensions, which consume more space.

FIG. 5A depicts a typical contour of a conventional printer 50, for contrast with the contour of the printer 100configured according to an embodiment of the present invention. Conventional printers, represented herein by the typical printer 50, rely on a mechanism 57 to provide mechanical force sufficient to move a supply 59 of a media substrate and place it into markable contact with a printhead thereof. The components of the typical conventional printer 50, including the mechanism 57 thereof, are disposed in a housing 58. The housing 58 of the typical conventional printer 50 may be characterized by a dimension 'B' 56.

The dimension 'B' 56, characteristic of the typical conventional printer 50, exceeds the dimension A 560, which characterizes the printer 100, implemented according to an example embodiment. Conversely, the dimension A 560, characteristic of the printer 100 of an example embodiment is smaller than the typical dimension B 56 of the conventional printer 50.

Figure 8:
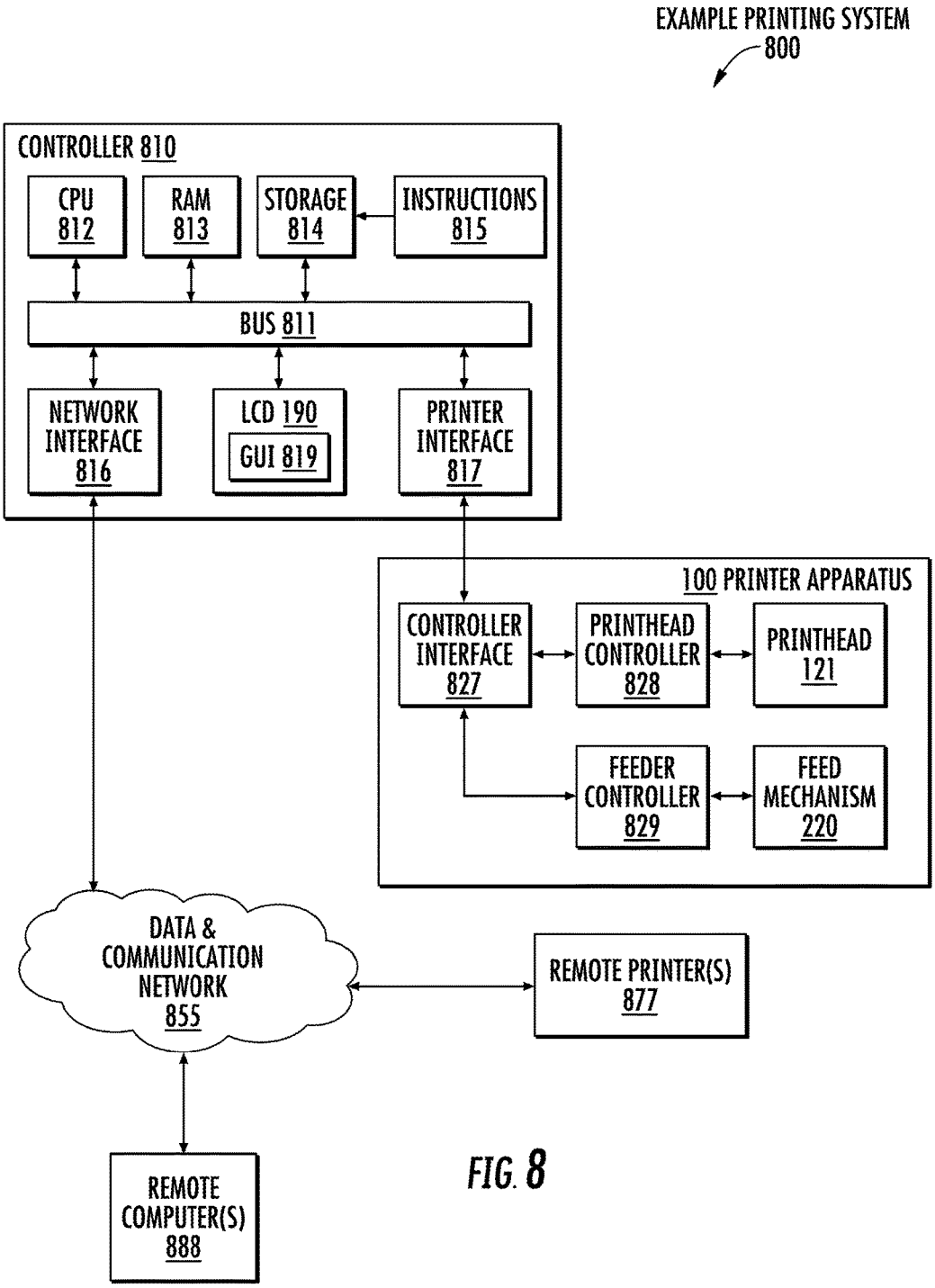
FIG. 8 depicts an example printing system, according to an embodiment of the present invention.

Example embodiments of the present invention relate to printing processes (e.g., method 80; FIG. 8) performed by the printer 100, and to graphic media products printed according to such processes.

Example Printer Media Products.

The image marked upon the media substrate 130 may comprise one or more symbols or indicia. For example, the symbols or indicia may comprise text based information, such as alphanumeric, and/or character or syllabary based text. The symbol may also (or alternatively) comprise ideographic, pictographic, or emblematic based graphics, images, or data patterns.

Figure 6A:
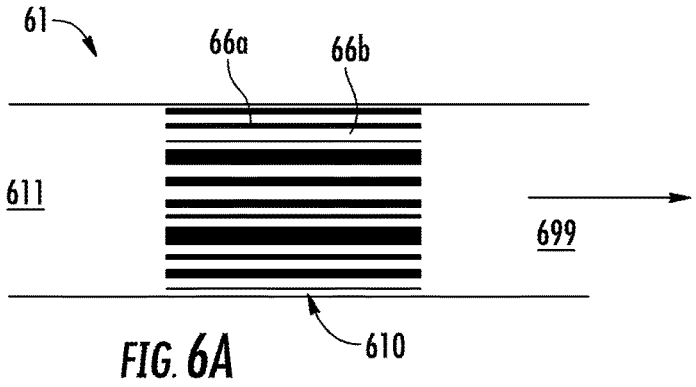
FIG. 6A depicts an example 1D 'drag' mode media product, according to an embodiment of the present invention.

FIG. 6A depicts an example 1D bar code pattern 610, according to an embodiment of the present invention. The 1D bar code symbol 610 is depicted as though printed in a 'picket fence' mode on the print medium 611.

Figure 6B:
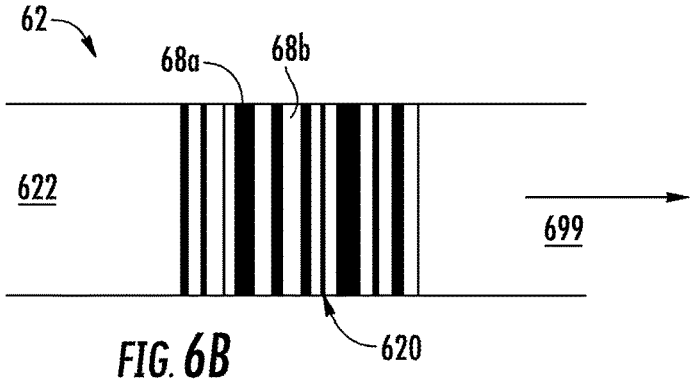
FIG. 6B depicts an example 1D 'ladder' mode media product, according to an embodiment of the present invention.

FIG. 6B depicts another example 1D bar code pattern 620, according to an embodiment of the present invention. The 1D bar code symbol 622 is depicted as though printed in a 'ladder' mode on a print medium 622.

The bar code symbols 610 and 620 each comprise a plurality of bar elements 66*a* and a plurality of space elements 66*b*. The space elements 66*b* are disposed in parallel with the bar elements 66*a*. In the picket fence mode, the bar code symbol 610 is printed parallel to the direction of printing 699. In the ladder mode, the bar code symbol 620 is printed in a perpendicular orientation to the direction of printing 699.

The bar code symbols 610 and 620 may each comprise data patterns related to, for example, an International (or "European") Article Number and/or Universal Product Code (EAN/UPC symbology) pattern, PDF417 (ISO/EC-15438 related) pattern, which comprise four of the vertical bar like symbols 66*a* disposed over 17 of the horizontally disposed spacer symbols 68*b*), 1D dot code pattern, or other 1D symbols.

Figure 6C:
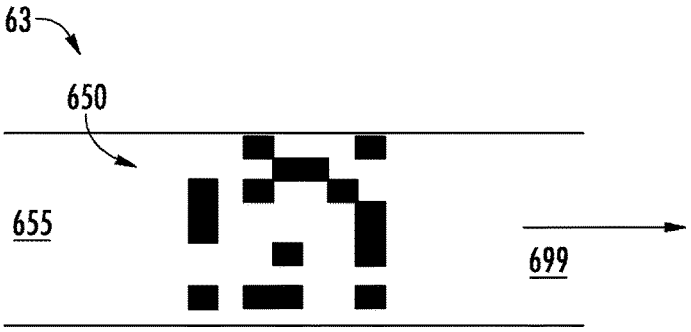
FIG. 6C depicts an example 2D media product, according to an embodiment of the present invention.

FIG. 6C depicts an example 2D matrix code pattern 650, according to an embodiment of the present invention. The 2D matrix code pattern 650 comprises a matrix of 2D graphic symbol parts, such as squares and other rectangle and polygons, printed on a print medium 655. The matrix data pattern 650 may comprise a 2D data pattern related to, for example, quick-response (QR) and/or Han Xin graphical or geometric data matrices, or other 2D symbols.

Figure 6D:
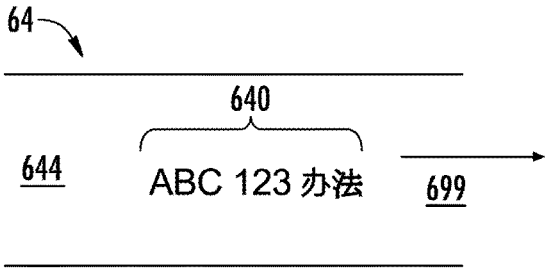
FIG. 6D depicts an example text based media product, according to an embodiment of the present invention.

FIG. 6D depicts an example text based code pattern 640, according to an embodiment of the present invention. The text based code pattern 640 comprises alphanumeric, character, or syllabary based text or other text related graphic symbol parts (e.g., OCR patterns), printed on a print medium 644. The code pattern 640 may comprise human readable and optical character recognition (OCR) readable symbol parts, such as numbers, letters, characters, and syllables printed on a print medium 644. The data pattern 640 may comprise a 2D data pattern related to, for example, OCR-B or OCR-A, or other 2D symbols.

The print media 611, 622, 644, and 655 each move longitudinally in a direction 699 of respective printing, marking, and/or feeding operations. The print media 611, 622, 644, and 655 may each comprise paper for receiving ink based markings, thermally sensitive paper, or plastic or other material. The print media 611, 622, 644, and 655 may be disposed in a web configuration, which is significantly longer than it is wide. The direction of printing 699 is parallel to a longitudinal axis of the print media 611, 622, 644, and 655, along which the media move.

The printing system 100 prints the symbols 610, 620, 640, and 650 on the respective web media 611, 622, 644, and 655 according to a printing process (e.g., method 20; FIG. 2A). An example embodiment may be implemented in which print logic generates a print command based on a reference pattern, to be printed centered in the target position. The print command and related reference pattern is used by a print driver to activate and energize print elements of the printing mechanism 121.

Responsive to the print command, for example, the activated and energized print mechanism 121 marks a part of the bar codes 610 and 620, matrix code 650 and/or text pattern 640 based on a reference pattern and the media 611, 622, 644, and/or 655, respectively, advance in the direction 699. Each time that the media is advanced, a print driver activates elements of the print mechanism 112 for the marking of subsequent bar elements 66*a*, and spacing of parallel space elements 66*b*, onto a segment (e.g., portion) onto the media 611, 622, and 655, and/or the text pattern portions onto the medium 644.

As the printed portions of the media 611, 622, 644 and 655 advance through the print mechanism, a bulk printed media product is produced. With 'linear' operable image heads, successive scan images of the printed element may be buffered sequentially into the scan memory area in a correspondence with the succession. The print command may be stored in a related memory area (FIG. 8).

Example Printing Process.

Figure 7:
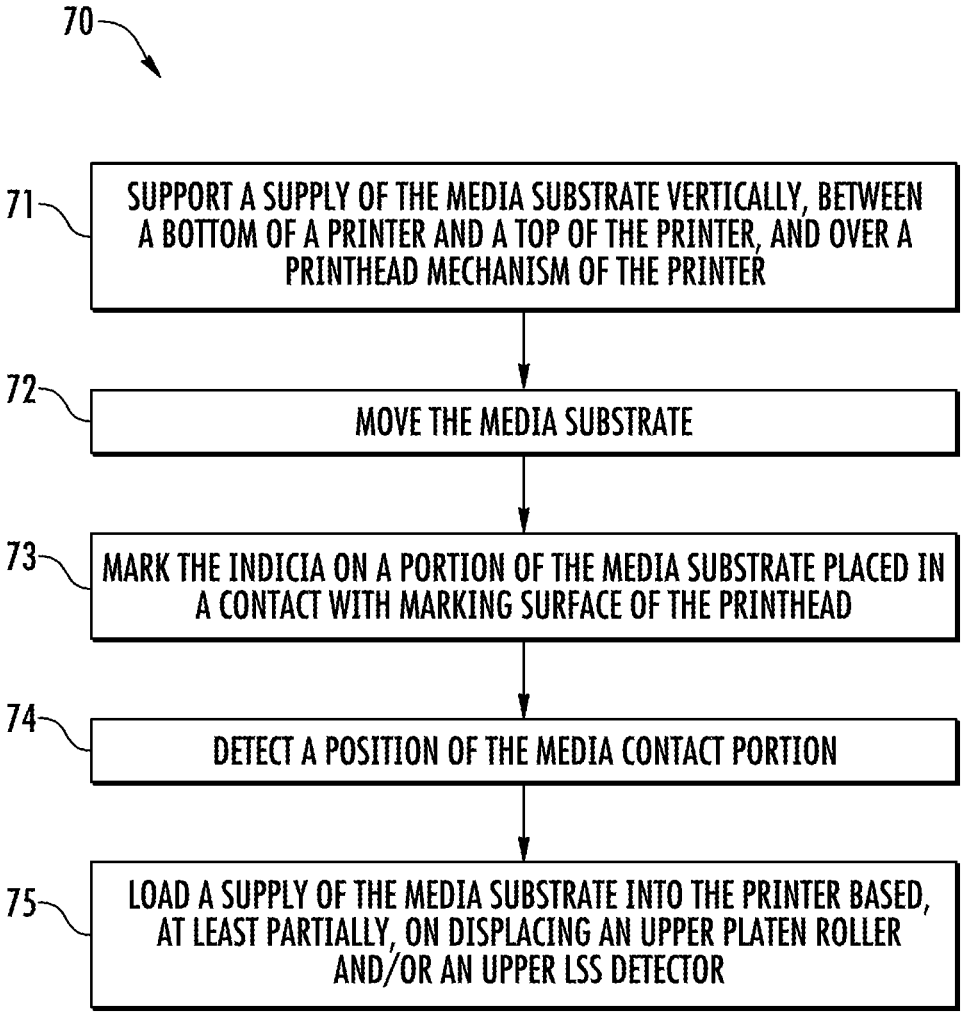
FIG. 7 depicts a flowchart for an example method for printing a graphic media product, according to an embodiment of the present invention.

In an example embodiment, the media products 61, 62, 63, and 64, may be printed by a process performed by the printer apparatus 100. FIG. 7 depicts a flowchart for an example method 70 for printing a graphic media product, according to an embodiment of the present invention. The process 70 begins with a step 71.

In the step 71, a supply of the media substrate is supported, vertically, between a bottom of a printer and a top of the printer, and over a printhead mechanism of the printer. The bottom of the printer is oriented, at least partially, in relation to a first plane. The top is oriented, at least partially, in relation to a second plane opposite from the first plane. A markable surface of the media substrate is placed in a contact with a marking surface of the printhead mechanism by a weight of the media substrate supply.

The method 70 also comprises a step 72, in which the media substrate is moved. In the moving of the media substrate, a portion thereof is displaced longitudinally over the marking surface of the printhead mechanism.

The method 70 comprises, further, a step 73. The step comprises marking the image on the portion of the media substrate placed in a contact with marking surface of the printhead.

The moving the media substrate may comprise an application of a mechanical force on the media substrate. The applying application of the mechanical force may comprise subjecting the media substrate to a traction parallel to a longitudinal axis thereof.

The application of the mechanical force may also comprise drawing the media substrate between a pair of platen rollers. The platen roller pair comprising a first platen roller, and a second platen roller. The second platen roller is disposed over the first platen roller, relative to the top of the printer and the bottom of the printer. The media substrate is drawn between the first platen roller and the second platen roller.

The method comprises, further still, a step 74. The step 74 comprises detecting a position of the media contact portion. The detection of the position of the media contact portion may comprise drawing the media substrate between a pair of label stop sensor (LSS) devices. The pair of LSS devices is disposed downstream of the pair of platen rollers, relative to the longitudinal displacement of the media substrate portion. The pair of LSS devices comprises a first LSS device, and a second LSS device. The second LSS device is disposed over the first LSS device, relative to the top and the bottom of the printer.

Yet further still, the method may comprise a step 75. The step 75 comprises loading the media substrate supply into the printer. The loading of the media substrate supply is based, at least partially, on a displacement of the second platen roller and the second LSS detector, vertically, towards the top of the printer. The displaced LSS detector and the displaced platen roller are disposed above another LSS detector and platen roller disposed, in relation to the top 113 and/or the bottom 111 of the housing 110 of the printer 100.

In an example embodiment, the method 80 is performed by the printer apparatus 100. An example embodiment of the present invention relates to a graphic media product (e.g., graphic media products 61, 62, 63, 64; FIG. 6A, 6B, 6C, 6D, respectively) marked on a media substrate by a process. The process may relate to the printing method 80. In an example embodiment, the method 80 is performed by an automated, computerized, and/or network-connected printer system.

Example Printer System and Network Platform.

An example embodiment may be implemented in which one or more components of the printer apparatus 100 are configured in electronic or computer based hardware, software stored physically (e.g., electrically, electronically, optically, electromagnetically, magnetically) in non-transitory computer readable storage media such as dynamic memory, flash memory, drives, caches, buffers, registers, latches, memory cells, or the like.

FIG. 8 depicts an example printing system 800, according to an embodiment of the present invention. The printer apparatus 100 comprises a controller interface 827, operable for exchanging data signals with a controller 828 and a controller 829.

The controller 828 is operable for exchanging data signals with the printhead 121. The controller 828 may transmit commands to the printhead 121. The controller 829 is operable for exchanging data signals with the feed mechanism 220. The controller 828 may transmit commands to the feed mechanism 220. Data signals from the printhead 121 and the feed mechanism 220 may be returned respectively therefrom via the controller interface 827.

The printing system 800 comprises a controller 810, which is operable for exchanging data signals with the printer apparatus 100 via a printer interface 817. The printing system 800 comprises a data bus 811. The printing system 800 also comprises a central processor unit (CPU) 812, a memory, such as a dynamically-operable random access memory (RAM) 813, and a data storage unit 814. The data storage unit, and the RAM 813, may comprise non-transitory computer-readable storage media.

The computer-readable storage media may comprise instructions, such as instructions 815. The instructions 815 may be operable for causing, configuring, controlling, and/or programming a printing process such as the method 70 (FIG. 7), and/or a process for printing graphic media products such as the media products 61, 62, 63, and/or 64 (FIGS. 6A, 6B, 6C, and 6D, respectively). The controller 810 may also comprise a statically-operable memory such as a read-only memory (ROM), and one or more additional processors, such as a graphic processing unit (GPU), digital signal processor (DSP), and or "math" (mathematics) co-processor, which may each be operable with an individual, dedicated, or shared dynamic memory.

The controller 810 may comprise the LCD 190. An example embodiment may be implemented in which the LCD 190 comprises a graphical user interface (GUI) 819, which is operable for receiving haptic user inputs. The controller 810 may also comprise a network interface 815.

The network interface 816 is operable for coupling and exchanging data, communicatively, with a data and communication network 855. One or more remote printers 877 and/or remote computers 888 may be coupled, communicatively, via the network 855, and/or controlled by the controller 810 (or control an operation of the printer 100).

Example Printer Apparatus.

Figure 9:
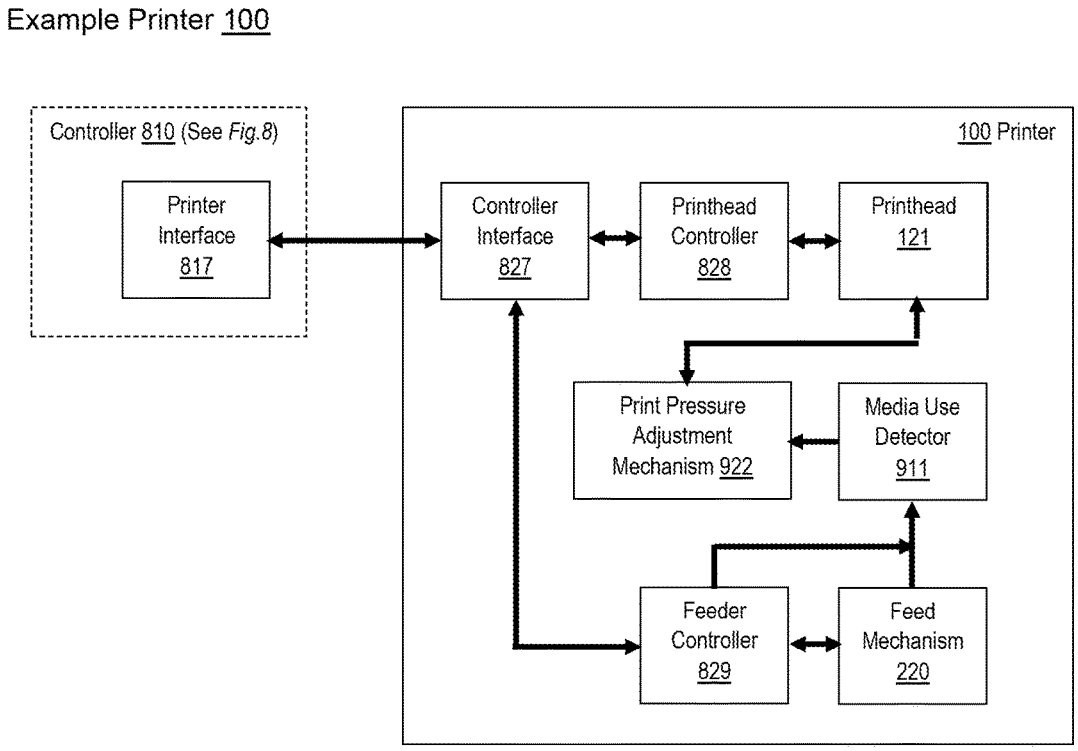
FIG. 9 depicts an example printer apparatus, according to an embodiment of the present invention.

FIG. 9 depicts an example of the printer apparatus 100, according to an embodiment of the present invention. An example embodiment of the present invention may be implemented in which the printer apparatus 100 comprises a media use detector 911 and a print pressure adjustment mechanism (PPAM) 922, in addition to the features described above with reference to FIG. 8.

The media use detector 911 is operable for detecting the use of a known, estimated, or approximate, and finite supply of the media substrate. The detection of the media use may be based on an input signal to the media use detector 911 from the feed mechanism 220 and/or from the feeder controller 829.

An example embodiment may be implemented in which the input signal is developed by the feed mechanism 220 and/or the feeder controller 829 electromechanically. During printing for example, the supply of the media substrate may be monitored electromechanically in real time based on detecting a change in a weight of a remainder of the media supply, a change in a degree of a mechanical strain exerted by the remainder of the media supply on the feed mechanism 220, and/or a change in the diameter of the media remaining on a supply spool thereof.

Alternatively or additionally, an example embodiment may be implemented in which the input signal is developed by the feed mechanism 220 and/or the feeder controller 829 electro-optically. During printing for example, the supply of the media substrate may be monitored electro-optically in real time based on detecting a change in the diameter of the media remaining on a supply spool thereof.

The electro-optical monitoring of the diameter may relate to detecting a colored, shaded, darkened marking, or a reflective marking, which is applied to an encoder disk in an alternating pattern. For example, a lightly shaded section may be followed by a darker shaded section, and with the encoder disk rotating at the same speed as the unspooling media substrate. Alternatively or additionally, the electro-optical monitoring may relate to detecting a changing diameter of the media substrate supply spool using one or more photocells and associated light sources.

* * *

To supplement the present disclosure, this application incorporates entirely by reference the following commonly assigned patents, patent application publications, and patent applications:

U.S. Pat. Nos. 6,832,725; 7,128,266; 7,159,783; 7,413,127; 7,726,575; 8,294,969; 8,317,105; 8,322,622; 8,366,005; 8,371,507; 8,376,233; 8,381,979; 8,390,909; 8,408,464; 8,408,468; 8,408,469; 8,424,768; 8,448,863; 8,457,013; 8,459,557; 8,469,272; 8,474,712; 8,479,992; 8,490,877; 8,517,271; 8,523,076; 8,528,818; 8,544,737; 8,548,242; 8,548,420; 8,550,335; 8,550,354; 8,550,357; 8,556,174; 8,556,176; 8,556,177; 8,559,767; 8,599,957; 8,561,895; 8,561,903; 8,561,905; 8,565,107; 8,571,307; 8,579,200; 8,583,924; 8,584,945; 8,587,595; 8,587,697; 8,588,869; 8,590,789; 8,596,539; 8,596,542; 8,596,543; 8,599,271;

8,599,957; 8,600,158; 8,600,167; 8,602,309; 8,608,053; 8,608,071; 8,611,309; 8,615,487; 8,616,454; 8,621,123; 8,622,303; 8,628,013; 8,628,015; 8,628,016; 8,629,926; 8,630,491; 8,635,309; 8,636,200; 8,636,212; 8,636,215; 8,636,224; 8,638,806; 8,640,958; 8,640,960; 8,643,717; 8,646,692; 8,646,694; 8,657,200; 8,659,397; 8,668,149; 8,678,285; 8,678,286; 8,682,077; 8,687,282; 8,692,927; 8,695,880; 8,698,949; 8,717,494; 8,717,494; 8,720,783; 8,723,804; 8,723,904; 8,727,223; D702,237; 8,740,082; 8,740,085; 8,746,563; 8,750,445; 8,752,766; 8,756,059; 8,757,495; 8,760,563; 8,763,909; 8,777,108; 8,777,109; 8,779,898; 8,781,520; 8,783,573; 8,789,757; 8,789,758; 8,789,759; 8,794,520; 8,794,522; 8,794,525; 8,794,526; 8,798,367; 8,807,431; 8,807,432; 8,820,630; 8,822,848; 8,824,692; 8,824,696; 8,842,849; 8,844,822; 8,844,823; 8,849,019; 8,851,383; 8,854,633; 8,866,963; 8,868,421; 8,868,519; 8,868,802; 8,868,803; 8,870,074; 8,879,639; 8,880,426; 8,881,983; 8,881,987; 8,903,172; 8,908,995; 8,910,870; 8,910,875; 8,914,290; 8,914,788; 8,915,439; 8,915,444; 8,916,789; 8,918,250; 8,918,564; 8,925,818; 8,939,374; 8,942,480; 8,944,313; 8,944,327; 8,944,332; 8,950,678; 8,967,468; 8,971,346; 8,976,030; 8,976,368; 8,978,981; 8,978,983; 8,978,984; 8,985,456; 8,985,457; 8,985,459; 8,985,461; 8,988,578; 8,988,590; 8,991,704; 8,996,194; 8,996,384; 9,002,641; 9,007,368; 9,010,641; 9,015,513; 9,016,576; 9,022,288; 9,030,964; 9,033,240; 9,033,242; 9,036,054; 9,037,344; 9,038,911; 9,038,915; 9,047,098; 9,047,359; 9,047,420; 9,047,525; 9,047,531; 9,053,055; 9,053,378; 9,053,380; 9,058,526; 9,064,165; 9,064,167; 9,064,168; 9,064,254; 9,066,032; 9,070,032;

U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D733,112;
U.S. Design Pat. No. D734,339;
International Publication No. 2013/163789;
International Publication No. 2013/173985;
International Publication No. 2014/019130;
International Publication No. 2014/110495;
U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0287258;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0313325;
U.S. Patent Application Publication No. 2013/0342717;
U.S. Patent Application Publication No. 2014/0001267;
U.S. Patent Application Publication No. 2014/0008439;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0042814;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0078341;
U.S. Patent Application Publication No. 2014/0078345;
U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0104451;
U.S. Patent Application Publication No. 2014/0106594;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0114530;
U.S. Patent Application Publication No. 2014/0124577;
U.S. Patent Application Publication No. 2014/0124579;
U.S. Patent Application Publication No. 2014/0125842;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131438;
U.S. Patent Application Publication No. 2014/0131441;
U.S. Patent Application Publication No. 2014/0131443;
U.S. Patent Application Publication No. 2014/0131444;
U.S. Patent Application Publication No. 2014/0131445;
U.S. Patent Application Publication No. 2014/0131448;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0151453;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166755;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0175172;
U.S. Patent Application Publication No. 2014/0191644;

U.S. Patent Application Publication No. 2014/0191913;
U.S. Patent Application Publication No. 2014/0197238;
U.S. Patent Application Publication No. 2014/0197239;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0217180;
U.S. Patent Application Publication No. 2014/0231500;
U.S. Patent Application Publication No. 2014/0232930;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0267609;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0278391;
U.S. Patent Application Publication No. 2014/0282210;
U.S. Patent Application Publication No. 2014/0284384;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0312121;
U.S. Patent Application Publication No. 2014/0319220;
U.S. Patent Application Publication No. 2014/0319221;
U.S. Patent Application Publication No. 2014/0326787;
U.S. Patent Application Publication No. 2014/0332590;
U.S. Patent Application Publication No. 2014/0344943;
U.S. Patent Application Publication No. 2014/0346233;
U.S. Patent Application Publication No. 2014/0351317;
U.S. Patent Application Publication No. 2014/0353373;
U.S. Patent Application Publication No. 2014/0361073;
U.S. Patent Application Publication No. 2014/0361082;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;
U.S. Patent Application Publication No. 2015/0003673;
U.S. Patent Application Publication No. 2015/0009338;
U.S. Patent Application Publication No. 2015/0009610;
U.S. Patent Application Publication No. 2015/0014416;
U.S. Patent Application Publication No. 2015/0021397;
U.S. Patent Application Publication No. 2015/0028102;
U.S. Patent Application Publication No. 2015/0028103;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0048168;
U.S. Patent Application Publication No. 2015/0049347;
U.S. Patent Application Publication No. 2015/0051992;
U.S. Patent Application Publication No. 2015/0053766;
U.S. Patent Application Publication No. 2015/0053768;
U.S. Patent Application Publication No. 2015/0053769;
U.S. Patent Application Publication No. 2015/0060544;
U.S. Patent Application Publication No. 2015/0062366;
U.S. Patent Application Publication No. 2015/0063215;
U.S. Patent Application Publication No. 2015/0063676;
U.S. Patent Application Publication No. 2015/0069130;
U.S. Patent Application Publication No. 2015/0071819;
U.S. Patent Application Publication No. 2015/0083800;
U.S. Patent Application Publication No. 2015/0086114;
U.S. Patent Application Publication No. 2015/0088522;
U.S. Patent Application Publication No. 2015/0096872;
U.S. Patent Application Publication No. 2015/0099557;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0129659;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0136854;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0144701;
U.S. Patent Application Publication No. 2015/0149946;
U.S. Patent Application Publication No. 2015/0161429;
U.S. Patent Application Publication No. 2015/0169925;
U.S. Patent Application Publication No. 2015/0169929;
U.S. Patent Application Publication No. 2015/0178523;
U.S. Patent Application Publication No. 2015/0178534;
U.S. Patent Application Publication No. 2015/0178535;
U.S. Patent Application Publication No. 2015/0178536;
U.S. Patent Application Publication No. 2015/0178537;
U.S. Patent Application Publication No. 2015/0181093;
U.S. Patent Application Publication No. 2015/0181109;

U.S. patent application Ser. No. 13/367,978 for a Laser Scanning Module Employing an Elastomeric U-Hinge Based Laser Scanning Assembly, filed Feb. 7, 2012 (Feng et al.);

U.S. patent application Ser. No. 29/458,405 for an Electronic Device, filed Jun. 19, 2013 (Fitch et al.);

U.S. patent application Ser. No. 29/459,620 for an Electronic Device Enclosure, filed Jul. 2, 2013 (London et al.);

U.S. patent application Ser. No. 29/468,118 for an Electronic Device Case, filed Sep. 26, 2013 (Oberpriller et al.);

U.S. patent application Ser. No. 14/150,393 for Indicia-reader Having Unitary Construction Scanner, filed Jan. 8, 2014 (Colavito et al.);

U.S. patent application Ser. No. 14/200,405 for Indicia Reader for Size-Limited Applications filed Mar. 7, 2014 (Feng et al.);

U.S. patent application Ser. No. 14/231,898 for Hand-Mounted Indicia-Reading Device with Finger Motion Triggering filed Apr. 1, 2014 (Van Horn et al.);

U.S. patent application Ser. No. 29/486,759 for an Imaging Terminal, filed Apr. 2, 2014 (Oberpriller et al.);

U.S. patent application Ser. No. 14/257,364 for Docking System and Method Using Near Field Communication filed Apr. 21, 2014 (Showering);

U.S. patent application Ser. No. 14/264,173 for Autofocus Lens System for Indicia Readers filed Apr. 29, 2014 (Ackley et al.);

U.S. patent application Ser. No. 14/277,337 for MULTI-PURPOSE OPTICAL READER, filed May 14, 2014 (Jovanovski et al.);

U.S. patent application Ser. No. 14/283,282 for TERMINAL HAVING ILLUMINATION AND FOCUS CONTROL filed May 21, 2014 (Liu et al.);

U.S. patent application Ser. No. 14/327,827 for a MOBILE-PHONE ADAPTER FOR ELECTRONIC TRANSACTIONS, filed Jul. 10, 2014 (Hejl);

U.S. patent application Ser. No. 14/334,934 for a SYSTEM AND METHOD FOR INDICIA VERIFICATION, filed Jul. 18, 2014 (Hejl);

U.S. patent application Ser. No. 14/339,708 for LASER SCANNING CODE SYMBOL READING SYSTEM, filed Jul. 24, 2014 (Xian et al.);

U.S. patent application Ser. No. 14/340,627 for an AXIALLY REINFORCED FLEXIBLE SCAN ELEMENT, filed Jul. 25, 2014 (Rueblinger et al.);

U.S. patent application Ser. No. 14/446,391 for MULTI-FUNCTION POINT OF SALE APPARATUS WITH OPTICAL SIGNATURE CAPTURE filed Jul. 30, 2014 (Good et al.);

U.S. patent application Ser. No. 14/452,697 for INTERACTIVE INDICIA READER, filed Aug. 6, 2014 (Todeschini);

U.S. patent application No. 14/453,019 for DIMENSIONING SYSTEM WITH GUIDED ALIGNMENT, filed Aug. 6, 2014 (Li et al.);

U.S. patent application No. 14/462,801 for MOBILE COMPUTING DEVICE WITH DATA COGNITION SOFTWARE, filed on Aug. 19, 2014 (Todeschini et al.);

U.S. patent application Ser. No. 14/483,056 for VARIABLE DEPTH OF FIELD BARCODE SCANNER filed Sep. 10, 2014 (McCloskey et al.);

U.S. patent application Ser. No. 14/513,808 for IDENTIFYING INVENTORY ITEMS IN A STORAGE FACILITY filed Oct. 14, 2014 (Singel et al.);

U.S. patent application Ser. No. 14/519,195 for HANDHELD DIMENSIONING SYSTEM WITH FEEDBACK filed Oct. 21, 2014 (Laffargue et al.);

U.S. patent application Ser. No. 14/519,179 for DIMENSIONING SYSTEM WITH MULTIPATH INTERFERENCE MITIGATION filed Oct. 21, 2014 (Thuries et al.);

U.S. patent application Ser. No. 14/519,211 for SYSTEM AND METHOD FOR DIMENSIONING filed Oct. 21, 2014 (Ackley et al.);

U.S. patent application Ser. No. 14/519,233 for HANDHELD DIMENSIONER WITH DATA-QUALITY INDICATION filed Oct. 21, 2014 (Laffargue et al.);

U.S. patent application Ser. No. 14/519,249 for HANDHELD DIMENSIONING SYSTEM WITH MEASUREMENT-CONFORMANCE FEEDBACK filed Oct. 21, 2014 (Ackley et al.);

U.S. patent application Ser. No. 14/527,191 for METHOD AND SYSTEM FOR RECOGNIZING SPEECH USING WILDCARDS IN AN EXPECTED RESPONSE filed Oct. 29, 2014 (Braho et al.);

U.S. patent application Ser. No. 14/529,563 for ADAPTABLE INTERFACE FOR A MOBILE COMPUTING DEVICE filed Oct. 31, 2014 (Schoon et al.);

U.S. patent application Ser. No. 14/529,857 for BARCODE READER WITH SECURITY FEATURES filed Oct. 31, 2014 (Todeschini et al.);

U.S. patent application No. 14/398,542 for PORTABLE ELECTRONIC DEVICES HAVING A SEPARATE LOCATION TRIGGER UNIT FOR USE IN CONTROLLING AN APPLICATION UNIT filed Nov. 3, 2014 (Bian et al.);

U.S. patent application Ser. No. 14/531,154 for DIRECTING AN INSPECTOR THROUGH AN INSPECTION filed Nov. 3, 2014 (Miller et al.);

U.S. patent application Ser. No. 14/533,319 for BARCODE SCANNING SYSTEM USING WEARABLE DEVICE WITH EMBEDDED CAMERA filed Nov. 5, 2014 (Todeschini);

U.S. patent application Ser. No. 14/535,764 for CONCATENATED EXPECTED RESPONSES FOR SPEECH RECOGNITION filed Nov. 7, 2014 (Braho et al.);

U.S. patent application Ser. No. 14/568,305 for AUTO-CONTRAST VIEWFINDER FOR AN INDICIA READER filed Dec. 12, 2014 (Todeschini);

U.S. patent application Ser. No. 14/573,022 for DYNAMIC DIAGNOSTIC INDICATOR GENERATION filed Dec. 17, 2014 (Goldsmith);

U.S. patent application Ser. No. 14/578,627 for SAFETY SYSTEM AND METHOD filed Dec. 22, 2014 (Ackley et al.);

U.S. patent application Ser. No. 14/580,262 for MEDIA GATE FOR THERMAL TRANSFER PRINTERS filed Dec. 23, 2014 (Bowles);

U.S. patent application Ser. No. 14/590,024 for SHELVING AND PACKAGE LOCATING SYSTEMS FOR DELIVERY VEHICLES filed Jan. 6, 2015 (Payne);

U.S. patent application Ser. No. 14/596,757 for SYSTEM AND METHOD FOR DETECTING BARCODE PRINTING ERRORS filed Jan. 14, 2015 (Ackley);

U.S. patent application Ser. No. 14/416,147 for OPTICAL READING APPARATUS HAVING VARIABLE SETTINGS filed Jan. 21, 2015 (Chen et al.);

U.S. patent application Ser. No. 14/614,706 for DEVICE FOR SUPPORTING AN ELECTRONIC TOOL ON A USER'S HAND filed Feb. 5, 2015 (Oberpriller et al.);

U.S. patent application Ser. No. 14/614,796 for CARGO APPORTIONMENT TECHNIQUES filed Feb. 5, 2015 (Morton et al.);

U.S. patent application Ser. No. 29/516,892 for TABLE COMPUTER filed Feb. 6, 2015 (Bidwell et al.);

U.S. patent application Ser. No. 14/619,093 for METHODS FOR TRAINING A SPEECH RECOGNITION SYSTEM filed Feb. 11, 2015 (Pecorari);

U.S. patent application Ser. No. 14/628,708 for DEVICE, SYSTEM, AND METHOD FOR DETERMINING THE STATUS OF CHECKOUT LANES filed Feb. 23, 2015 (Todeschini);

U.S. patent application Ser. No. 14/630,841 for TERMINAL INCLUDING IMAGING ASSEMBLY filed Feb. 25, 2015 (Gomez et al.);

U.S. patent application No. 14/635,346 for SYSTEM AND METHOD FOR RELIABLE STORE-AND-FORWARD DATA HANDLING BY ENCODED INFORMATION READING TERMINALS filed Mar. 2, 2015 (Sevier);

U.S. patent application Ser. No. 29/519,017 for SCANNER filed Mar. 2, 2015 (Zhou et al.);

U.S. patent application Ser. No. 14/405,278 for DESIGN PATTERN FOR SECURE STORE filed Mar. 9, 2015 (Zhu et al.);

U.S. patent application Ser. No. 14/660,970 for DECODABLE INDICIA READING TERMINAL WITH COMBINED ILLUMINATION filed Mar. 18, 2015 (Kearney et al.);

U.S. patent application Ser. No. 14/661,013 for REPROGRAMMING SYSTEM AND METHOD FOR DEVICES INCLUDING PROGRAMMING SYMBOL filed Mar. 18, 2015 (Soule et al.);

U.S. patent application Ser. No. 14/662,922 for MULTI-FUNCTION POINT OF SALE SYSTEM filed Mar, 19, 2015 (Van Horn et al.);

U.S. patent application Ser. No. 14/663,638 for VEHICLE MOUNT COMPUTER WITH CONFIGURABLE IGNITION SWITCH BEHAVIOR filed Mar. 20, 2015 (Davis et al.);

U.S. patent application Ser. No. 14/664,063 for METHOD AND APPLICATION FOR SCANNING A BARCODE WITH A SMART DEVICE WHILE CONTINUOUSLY RUNNING AND DISPLAYING AN APPLICATION ON THE SMART DEVICE DISPLAY filed Mar. 20, 2015 (Todeschini);

U.S. patent application Ser. No. 14/669,280 for TRANSFORMING COMPONENTS OF A WEB PAGE TO VOICE PROMPTS filed Mar. 26, 2015 (Funyak et al.);

U.S. patent application Ser. No. 14/674,329 for AIMER FOR BARCODE SCANNING filed Mar. 31, 2015 (Bidwell);

U.S. patent application Ser. No. 14/676,109 for INDICIA READER filed Apr. 1, 2015 (Huck);

U.S. patent application Ser. No. 14/676,327 for DEVICE MANAGEMENT PROXY FOR SECURE DEVICES filed Apr. 1, 2015 (Yeakley et al.);

U.S. patent application Ser. No. 14/676,898 for NAVIGATION SYSTEM CONFIGURED TO INTEGRATE MOTION SENSING DEVICE INPUTS filed Apr. 2, 2015 (Showering);

U.S. patent application Ser. No. 14/679,275 for DIMENSIONING SYSTEM CALIBRATION SYSTEMS AND METHODS filed Apr. 6, 2015 (Laffargue et al.);

U.S. patent application Ser. No. 29/523,098 for HANDLE FOR A TABLET COMPUTER filed Apr. 7, 2015 (Bidwell et al.);

U.S. patent application Ser. No. 14/682,615 for SYSTEM AND METHOD FOR POWER MANAGEMENT OF MOBILE DEVICES filed Apr. 9, 2015 (Murawski et al.);

U.S. patent application Ser. No. 14/686,822 for MULTIPLE PLATFORM SUPPORT SYSTEM AND METHOD filed Apr. 15, 2015 (Qu et al.);

U.S. patent application Ser. No. 14/687,289 for SYSTEM FOR COMMUNICATION VIA A PERIPHERAL HUB filed Apr. 15, 2015 (Kohtz et al.);

U.S. patent application Ser. No. 29/524,186 for SCANNER filed Apr. 17, 2015 (Zhou et al.);

U.S. patent application Ser. No. 14/695,364 for MEDICATION MANAGEMENT SYSTEM filed Apr. 24, 2015 (Sewell et al.);

U.S. patent application Ser. No. 14/695,923 for SECURE UNATTENDED NETWORK AUTHENTICATION filed Apr. 24, 2015 (Kubler et al.);

U.S. patent application Ser. No. 29/525,068 for TABLET COMPUTER WITH REMOVABLE SCANNING DEVICE filed Apr. 27, 2015 (Schulte et al.);

U.S. patent application Ser. No. 14/699,436 for SYMBOL READING SYSTEM HAVING PREDICTIVE DIAGNOSTICS filed Apr. 29, 2015 (Nahill et al.);

U.S. patent application Ser. No. 14/702,110 for SYSTEM AND METHOD FOR REGULATING BARCODE DATA INJECTION INTO A RUNNING APPLICATION ON A SMART DEVICE filed May 1, 2015 (Todeschini et al.);

U.S. patent application Ser. No. 14/702,979 for TRACKING BATTERY CONDITIONS filed May 4, 2015 (Young et al.);

U.S. patent application Ser. No. 14/704,050 for INTERMEDIATE LINEAR POSITIONING filed May 5, 2015 (Charpentier et al.);

U.S. patent application Ser. No. 14/705,012 for HANDS-FREE HUMAN MACHINE INTERFACE RESPONSIVE TO A DRIVER OF A VEHICLE filed May 6, 2015 (Fitch et al.);

U.S. patent application Ser. No. 14/705,407 for METHOD AND SYSTEM TO PROTECT SOFTWARE-BASED NETWORK-CONNECTED DEVICES FROM ADVANCED PERSISTENT THREAT filed May 6, 2015 (Hussey et al.);

U.S. patent application Ser. No. 14/707,037 for SYSTEM AND METHOD FOR DISPLAY OF INFORMATION USING A VEHICLE-MOUNT COMPUTER filed May 8, 2015 (Chamberlin);

U.S. patent application Ser. No. 14/707,123 for APPLICATION INDEPENDENT DEX/UCS INTERFACE filed May 8, 2015 (Pape);

U.S. patent application Ser. No. 14/707,492 for METHOD AND APPARATUS FOR READING OPTICAL INDICIA USING A PLURALITY OF DATA SOURCES filed May 8, 2015 (Smith et al.);

U.S. patent application Ser. No. 14/710,666 for PRE-PAID USAGE SYSTEM FOR ENCODED INFORMATION READING TERMINALS filed May 13, 2015 (Smith);

U.S. patent application Ser. No. 29/526,918 for CHARGING BASE filed May 14, 2015 (Fitch et al.);

U.S. patent application Ser. No. 14/715,672 for AUGUMENTED REALITY ENABLED HAZARD DISPLAY filed May 19, 2015 (Venkatesha et al.);

U.S. patent application Ser. No. 14/715,916 for EVALUATING IMAGE VALUES filed May 19, 2015 (Ackley);

U.S. patent application Ser. No. 14/722,608 for INTERACTIVE USER INTERFACE FOR CAPTURING A DOCUMENT IN AN IMAGE SIGNAL filed May 27, 2015 (Showering et al.);

U.S. patent application Ser. No. 29/528,165 for IN-COUNTER BARCODE SCANNER filed May 27, 2015 (Oberpriller et al.);

U.S. patent application Ser. No. 14/724,134 for ELECTRONIC DEVICE WITH WIRELESS PATH SELECTION CAPABILITY filed May 28, 2015 (Wang et al.);

U.S. patent application Ser. No. 14/724,849 for METHOD OF PROGRAMMING THE DEFAULT CABLE INTERFACE SOFTWARE IN AN INDICIA READING DEVICE filed May 29, 2015 (Barten);

U.S. patent application Ser. No. 14/724,908 for IMAGING APPARATUS HAVING IMAGING ASSEMBLY filed May 29, 2015 (Barber et al.);

U.S. patent application Ser. No. 14/725,352 for APPARATUS AND METHODS FOR MONITORING ONE OR MORE PORTABLE DATA TERMINALS (Caballero et al.);

U.S. patent application Ser. No. 29/528,590 for ELECTRONIC DEVICE filed May 29, 2015 (Fitch et al.);

U.S. patent application Ser. No. 29/528,890 for MOBILE COMPUTER HOUSING filed Jun. 2, 2015 (Fitch et al.);

U.S. patent application Ser. No. 14/728,397 for DEVICE MANAGEMENT USING VIRTUAL INTERFACES CROSS-REFERENCE TO RELATED APPLICATIONS filed Jun. 2, 2015 (Caballero);

U.S. patent application Ser. No. 14/732,870 for DATA COLLECTION MODULE AND SYSTEM filed Jun. 8, 2015 (Powilleit);

U.S. patent application Ser. No. 29/529,441 for INDICIA READING DEVICE filed Jun. 8, 2015 (Zhou et al.);

U.S. patent application Ser. No. 14/735,717 for INDICIA-READING SYSTEMS HAVING AN INTERFACE WITH A USER'S NERVOUS SYSTEM filed Jun. 10, 2015 (Todeschini);

U.S. patent application Ser. No. 14/738,038 for METHOD OF AND SYSTEM FOR DETECTING OBJECT WEIGHING INTERFERENCES filed Jun. 12, 2015 (Amundsen et al.);

U.S. patent application Ser. No. 14/740,320 for TACTILE SWITCH FOR A MOBILE ELECTRONIC DEVICE filed Jun. 16, 2015 (Bandringa);

U.S. patent application Ser. No. 14/740,373 for CALIBRATING A VOLUME DIMENSIONER filed Jun. 16, 2015 (Ackley et al.);

U.S. patent application Ser. No. 14/742,818 for INDICIA READING SYSTEM EMPLOYING DIGITAL GAIN CONTROL filed Jun. 18, 2015 (Xian et al.);

U.S. patent application Ser. No. 14/743,257 for WIRELESS MESH POINT PORTABLE DATA TERMINAL filed Jun. 18, 2015 (Wang et al.);

U.S. patent application Ser. No. 29/530,600 for CYCLONE filed Jun. 18, 2015 (Vargo et al);

U.S. patent application Ser. No. 14/744,633 for IMAGING APPARATUS COMPRISING IMAGE SENSOR ARRAY HAVING SHARED GLOBAL SHUTTER CIRCUITRY filed Jun. 19, 2015 (Wang);

U.S. patent application Ser. No. 14/744,836 for CLOUD-BASED SYSTEM FOR READING OF DECODABLE INDICIA filed Jun. 19, 2015 (Todeschini et al.);

U.S. patent application Ser. No. 14/745,006 for SELECTIVE OUTPUT OF DECODED MESSAGE DATA filed Jun. 19, 2015 (Todeschini et al.);

U.S. patent application Ser. No. 14/747,197 for OPTICAL PATTERN PROJECTOR filed Jun. 23, 2015 (Thuries et al.);

U.S. patent application Ser. No. 14/747,490 for DUAL-PROJECTOR THREE-DIMENSIONAL SCANNER filed Jun. 23, 2015 (Jovanovski et al.); and U.S. patent application Ser. No. 14/748,446 for CORDLESS INDICIA READER WITH A MULTIFUNCTION COIL FOR WIRELESS CHARGING AND EAS DEACTIVATION, filed Jun. 24, 2015 (Xie et al.).

* * *

Example embodiments of the present invention are thus described in relation to printing apparatus and a method for printing media products. An example embodiment of the present invention relates to a printer. The printer is operable for marking an image on a media substrate. The printer comprises a housing and a printhead. The printhead is operable for marking an image on a surface of a media substrate held in proximity therewith by a weight of a supply of the media substrate from which the media substrate is fed. The media substrate supply is disposed in the housing over the printhead.

Example embodiments of the present invention are thus useful, for example, with printers comprising a small size, amount of material, number of components, and complexity, relative, for example, to conventional printers. The relatively simple printers associated with example embodiments of the present invention also comprise a correspondingly higher reliability level. The relatively less material, fewer components, and lower complexity of the printers implemented according to example embodiments, further, may reduce costs associated with their fabrication, procurement, and maintenance.

For clarity and brevity, as well as to avoid unnecessary or unhelpful obfuscating, obscuring, obstructing, or occluding features of an example embodiment, certain intricacies and details, which are known generally to artisans of ordinary skill in related technologies, may have been omitted or discussed in less than exhaustive detail. Any such omissions or discussions are neither necessary for describing example embodiments of the invention, nor particularly relevant to understanding of significant elements, features, functions, and aspects of the example embodiments described herein.

In the specification and/or figures, typical embodiments of the invention have been disclosed. The present invention is not limited to such example embodiments. The use of the term "and/or" includes any and all combinations of one or more of the associated listed items, and the term "or" is used in an inclusive (and not exclusive) sense. The figures are schematic representations and so are not necessarily drawn to scale. Unless otherwise noted, specific terms have been used in a generic and descriptive sense and not for purposes of limitation.

What is claimed is:

1. A printer, comprising:

a housing;

a printhead comprising a printhead marking surface, wherein the printhead is operable for marking an image on a surface of a media substrate; and a hanger disposed in the housing for movably suspending a supply of the media substrate over the printhead such that a weight of the supply holds the surface of the media substrate in proximity to the printhead marking surface.

2. The printer as described in claim 1 wherein the printhead comprises a thermal printhead (TPH) and the media substrate comprises a thermally sensitive markable material fed from the supply over a portion of the TPH operable for the marking of the image.

3. The printer as described in claim 2 wherein the thermally sensitive markable material comprises one or more of a thermally sensitive medium disposed in web related configuration, or a thermal transfer medium disposed in a ribbon related configuration.

4. The printer as described in claim 2 wherein the TPH comprises a plurality of electrically resistive elements disposed in a linear array configured in a horizontal orientation perpendicular to a direction in which the media substrate is fed.

5. The printer as described in claim 4, wherein the image comprises a plurality of picture elements (pixels) marked upon the media surface, each of the pixels corresponding to a point disposed spatially at a discrete position on a burn line corresponding to the horizontal orientation of the linear array of the resistive elements, based on a controllable energization state of one of the resistive elements, wherein the burn line runs parallel to one or more burn lines disposed successively in the perpendicular horizontal orientation.

6. The printer as described in claim 5, wherein each of the pixels comprises at least a brightness characteristic contrasting controllably with a brightness characteristic of a background area of the media substrate surface proximate thereto.

7. The printer as described in claim 5 wherein the marking of the image comprises heating one or more locations disposed over the burn line, controllably, based on one or more of an input to the printer related to one or more of graphic data corresponding to the image, a stored instance of the image, or a programmed instance of the image.

8. The printer as described in claim 1 wherein the image comprises a marking agent compatible with a material property of the media substrate and deposited controllably with the printhead over one or more spatial portions of a surface of the media substrate, based on one or more of an input to the printer related to one or more of graphic data corresponding to the image, a stored instance of the image, or a programmed instance of the image.

9. The printer as described in claim 1 further comprising a feed mechanism operable for moving the media substrate from the supply thereof to the printhead.

10. The printer as described in claim 9 wherein the moving of the media substrate comprises applying one or more of a traction, or a mechanical force to the media substrate.

11. The printer as described in claim 10 wherein the mechanical force comprises one or more of a tension or a friction applied to the media substrate in the direction of the moving thereof.

12. The printer as described in claim 9 wherein the feed mechanism comprises a pair of rollers operable for the applying the mechanical force to the media substrate, the roller pair comprising a lower roller, and an upper roller disposed over the lower roller, relative to one or more of a top of the housing or a bottom thereof, wherein the media substrate is drawn between the lower roller and the upper roller.

13. The printer as described in claim 12 further comprising at least one sensor disposed downstream of the pair of rollers, relative to the moving of the media substrate, and operable for detecting a longitudinal position of at least a portion of the media substrate relative to the direction of the moving thereof.

14. The printer as described in claim 13 wherein the at least one sensor comprises one or more of:

a reflection based sensor device operable electro-optically for detecting a reflection of light from the surface of the media substrate illuminated therewith and corresponding spatially to the longitudinal position; or a pair of label stop sensor (LSS) devices comprising a lower LSS device, and an upper LSS device disposed over the lower LSS device relative to the top and the bottom of the housing, wherein upon the moving, at least a portion of the media substrate is drawn between the lower LSS device and the upper LSS device.

15. The printer as described in claim 14 wherein the media substrate supply is loadable into the housing based, at least partially, on a displacement of the upper roller and the upper LSS device vertically towards the top of the housing.

16. The printer as described in claim 12 wherein the media substrate comprises a material compatibly markable with the printhead and configured, prior to the moving thereof, as a roll disposed on a spool, and wherein upon the moving, the media substrate portion is drawn from the spool in the direction of the movement and in one or more of a web configuration or a ribbon configuration.

17. The printer as described in claim 1 wherein the hanger is disposed movably between a top and a bottom of the housing for vertically suspending the media substrate supply.

18. The printer as described in claim 17 wherein the hanger is operable for the suspending of the media substrate supply over one or more of:

the movement of the media substrate surface over the printhead;

a consumption of the media substrate supply related to one or more of the moving thereof or the marking of the image; or a reduction in the weight of the media substrate supply corresponding to the consumption thereof.

19. The printer as described in claim 1, further comprising a print pressure adjustment mechanism operable for controlling the printhead in relation to adjusting the marking of the image on the media substrate based on a degree of consumption related to the supply of the media substrate.

20. The printer as described in claim 19, further comprising a media use detector operable with the print pressure adjustment mechanism and operable for detecting the degree of consumption of the media substrate supply.

21. The printer as described in claim 20, wherein the detecting of the degree of consumption of the media substrate supply is based on a monitoring of a remainder of the media substrate supply by one or more of a feed mechanism or a controller associated with an operation of the feed mechanism.

22. The printer as described in claim 20, wherein the detecting of the degree of consumption of the media substrate supply is performed with one or more of an electromechanical operation or an electro-optical operation of the media use detector.

23. A method for printing a graphic media product, the method comprising:

suspending a supply of a media substrate over a printhead comprising a printhead marking surface that a weight of the supply holds a surface of the media substrate in proximity to the printhead marking surface;

marking an image on the surface of the media substrate in proximity to the printhead marking surface; and moving an unmarked portion of the media substrate from the supply over the printhead.

* * * * *